US009304488B2

(12) United States Patent
Toba et al.

(10) Patent No.: US 9,304,488 B2
(45) Date of Patent: Apr. 5, 2016

(54) CARTRIDGE PACKAGE AND PACKAGEABLE PROCESS CARTRIDGE

(71) Applicant: CANON KABUSHIKI KAISHA, Tokyo (JP)

(72) Inventors: Shinjiro Toba, Yokohama (JP); Yuichi Fukui, Yokosuka (JP); Taiji Watanabe, Yashio (JP); Kengo Sakai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/297,873

(22) Filed: Jun. 6, 2014

(65) Prior Publication Data

US 2014/0361030 A1 Dec. 11, 2014

(30) Foreign Application Priority Data

Jun. 7, 2013 (JP) ..... 2013-120998

(51) Int. Cl.
*G03G 21/16* (2006.01)
*G03G 21/18* (2006.01)

(52) U.S. Cl.
CPC ..... *G03G 21/181* (2013.01); *G03G 2221/1684* (2013.01); *G03G 2221/1807* (2013.01)

(58) Field of Classification Search
USPC ..... 399/107, 109–111
See application file for complete search history.

(56) References Cited

U.S. PATENT DOCUMENTS 4,912,510 A * 3/1990 Ogura et al. ..... G03B 27/32 206/393
5,788,105 A 8/1998 Foos
5,802,431 A * 9/1998 Nagashima et al. ..... G03G 15/0855 222/DIG. 1
6,223,014 B1 4/2001 Niwano et al.
6,424,811 B1 7/2002 Tsuda et al.
6,519,431 B1 2/2003 Toba et al.
6,542,706 B2 4/2003 Toba et al.
6,549,736 B2 4/2003 Miyabe et al.
6,603,939 B1 8/2003 Toba et al.
6,678,488 B2 1/2004 Toba et al.
6,836,629 B2 12/2004 Miyabe et al.
6,937,834 B2 8/2005 Kanno et al.
6,990,302 B2 1/2006 Toba et al.

(Continued)

FOREIGN PATENT DOCUMENTS

JP H 04-114173 A 4/1992
JP 04269769 * 9/1992

(Continued)

OTHER PUBLICATIONS

Office Action in Taiwanese Patent Application No. 103118826, dated Aug. 10, 2015 (with English translation).

*Primary Examiner* — Hoan Tran
(74) *Attorney, Agent, or Firm* — Fitzpatrick, Cella, Harper & Scinto

(57) ABSTRACT

A packing member for packing a cartridge for an image forming apparatus, the packing member includes a frame portion having a recess for accommodating the cartridge; a closing member portion for openably closing the recess; a hinge portion for movably connecting the closing member portion relative to the frame portion to open and close the recess; a connecting portion connecting the frame portion and the closing member portion to close the recess; and the closing member portion being provided with a separating portion removable from the closing member portion while leaving the connecting portion on the frame portion.

30 Claims, 20 Drawing Sheets

(56) References Cited

U.S. PATENT DOCUMENTS

| | | | | |
|---|---|---|---|---|
| 7,128,211 | B2 | 10/2006 | Nishi et al. | |
| 7,149,457 | B2 | 12/2006 | Miyabe et al. | |
| 7,158,736 | B2 | 1/2007 | Sato et al. | |
| 7,164,875 | B2 | 1/2007 | Miyabe et al. | |
| 7,212,768 | B2 | 5/2007 | Numagami et al. | |
| 7,218,882 | B2 | 5/2007 | Toba et al. | |
| 7,224,925 | B2 | 5/2007 | Sato et al. | |
| 7,248,810 | B2 | 7/2007 | Miyabe et al. | |
| 7,311,204 | B2 | 12/2007 | Nishi et al. | |
| 7,349,657 | B2 | 3/2008 | Sato et al. | |
| 7,412,193 | B2 | 8/2008 | Sato et al. | |
| 7,464,520 | B2 | 12/2008 | Nishi et al. | |
| 7,681,379 | B2 | 3/2010 | Nishi et al. | |
| 7,715,746 | B2 | 5/2010 | Tanabe et al. | |
| 7,860,433 | B2 | 12/2010 | Toba et al. | |
| 7,894,733 | B2 | 2/2011 | Tanabe et al. | |
| 7,953,340 | B2 | 5/2011 | Tanabe et al. | |
| 8,213,831 | B2 | 7/2012 | Toba et al. | |
| 8,301,054 | B2 | 10/2012 | Tanabe et al. | |
| 8,521,060 | B2 | 8/2013 | Numata et al. | |
| 8,712,284 | B2 | 4/2014 | Toba et al. | |
| 2006/0193654 | A1* | 8/2006 | Kamimura | 399/103 |
| 2011/0311269 | A1* | 12/2011 | Murooka | 399/110 |
| 2012/0183327 | A1* | 7/2012 | Watanabe et al. | 399/111 |
| 2012/0243905 | A1 | 9/2012 | Uratani et al. | |
| 2013/0022368 | A1 | 1/2013 | Takarada et al. | |
| 2013/0114972 | A1 | 5/2013 | Takarada et al. | |
| 2013/0164029 | A1 | 6/2013 | Fukui et al. | |
| 2013/0177334 | A1 | 7/2013 | Nonaka et al. | |
| 2013/0251402 | A1 | 9/2013 | Yamashita et al. | |
| 2013/0308971 | A1 | 11/2013 | Kashiide et al. | |
| 2014/0064777 | A1 | 3/2014 | Toba | |
| 2014/0334844 | A1 | 11/2014 | Fukui et al. | |

FOREIGN PATENT DOCUMENTS

| | | | |
|---|---|---|---|
| JP | 2004-338785 | A | 12/2004 |
| TW | 201135379 | A | 10/2011 |

* cited by examiner (a)

(b)

CARTRIDGE PACKAGE AND PACKAGEABLE PROCESS CARTRIDGE

FIELD OF THE INVENTION AND RELATED ART

The present invention relates to a package for a cartridge removably installable in the main assembly of an image forming apparatus, and a packageable process cartridge.

Examples of an image forming apparatus to which the present invention is related include an electrophotographic copying machine, an electrophotographic printer (laser beam printer, LED printer, and the like, for example), a facsimile apparatus, a word processor, etc. Examples of a cartridge to which the present invention is related are cartridges having an electrophotographic photosensitive member as an image bearing member, cartridges in which an electrophotographic photosensitive member and a developing means for processing the electrophotographic member, are integrally placed, and the like cartridges. There cartridges are removably installable in the main assembly of an image forming apparatus.

A cartridge package means a package for protecting a cartridge from external vibrations and impacts to which a cartridge might be subjected during cartridge shipment.

An electrophotographic image forming apparatus, such as a printer, which uses an electrophotographic process, uniformly charges the peripheral surface of its electrophotographic photosensitive member as an image bearing member, and selectively exposes the various points of the uniformly charged area of the peripheral surface of the photosensitive drum to form a latent image on the peripheral surface of the photosensitive drum. Then, it develops the latent image into a visible image, that is, an image formed of developer (which hereafter may be referred to simply as developer image), with the used of developer. Then, it transfers the image formed of developer, onto a sheet of recording medium.

Then, the image forming apparatus applies heat and/or pressure to the developer image to fix the developer image to the sheet of recording medium in order to permanently record an image on the sheet of recording medium. Generally speaking, an electrophotographic image forming apparatus needs to be regularly maintained. For example, it has to be replenished with developer, and/or various processing means of the apparatus need to be regularly serviced.

One of the means for making it easier to supply an image forming apparatus with developer, and/or servicing the processing means of the apparatus is to employ a process cartridge system, which integrally places one or more of the electrophotographic photosensitive member, charging means, developing means, cleaning means, etc., for an image forming apparatus, in a cartridge which is removably mountable in the main assembly of the apparatus.

A process cartridge system enables a user himself or herself to maintain an electrophotographic image forming apparatus simply by replacing a process cartridge (which hereafter may be referred to simply as cartridge) in the main assembly of the apparatus with another process cartridge. Thus, it can drastically improve an electrophotographic image forming apparatus in operational efficiency. That is, a cartridge which is removably installable can be replaced by a user himself or herself. Thus, in recent years, it has become a common practice for a cartridge to be removed from an electrophotographic image forming apparatus, and replaced with a new cartridge.

When a brand-new cartridge is shipped out of a cartridge production facility, it is in a package for protecting the cartridge from the vibrations, impacts, and the like, which might occur while the cartridge is transported. The package is opened when a brand-new cartridge is installed into the main assembly of an electrophotographic image forming apparatus. Then, the handhold of the cartridge is grasped by a user (operator). Then, the cartridge is removed from the package, and is installed into the main assembly of the image forming apparatus.

There are various packages in which a cartridge can be placed to be protected from the vibrations and impacts which occur during cartridge transportation. Some examples of cartridge package are proposed in Japanese Patent No. 3,639,834 and Japanese Laid-open Patent Application H04-114173.

In the case of the cartridge package disclosed in Japanese Patent No. 3,639,834, it is formed by extruding the material for the package, in such a manner that the shape of the resulting cartridge package matches the external shape of the cartridge. More concretely, the package has multiple protrusions and recesses, which accommodate the cartridge while supporting the cartridge. Further, the openings which the lengthwise ends of the package has are sealed with a cover, which also is shaped so that it matches the external shape of the cartridge.

However, cartridge packages structured according to the prior art have the following issues.

That is, in order to secure a cartridge to a cartridge package, the lengthwise ends in terms of the direction parallel to the axial line of the electrophotographic photosensitive member of the cartridge are fitted with a pair of lids to regulate the cartridge movement in the direction parallel to the axial line of the electrophotographic photosensitive member. These lids, however, are different in structure. In other words, the cartridge package is complicated in structure, being therefore costly. Further, when an operator (user) is removing the cartridge from the cartridge package, the user has to slide each lid, which is at the end of the package, in the direction parallel to the abovementioned axial line to separate the lids from the main portion of the package. Then, the user has to slide the cartridge in the direction parallel to the axial line to move the cartridge out of the cartridge package. In other words, the user has to go through a complicated process to take the cartridge out of the cartridge package.

SUMMARY OF THE INVENTION

Thus, the primary object of the present invention is to provide a cartridge package which is simple in structure, the lids of which are easy to open, and which can protect the cartridge from the vibrations and impacts which might occur during cartridge shipment.

According to an aspect of the present invention, there is provided a packing member for packing a cartridge for an image forming apparatus, said packing member comprising a frame portion having a recess for accommodating said cartridge; a closing member portion for openably closing said recess; a hinge portion for movably connecting said closing member portion relative to said frame portion to open and close said recess; a connecting portion connecting said frame portion and said closing member portion to close said recess; and said closing member portion being provided with a separating portion removable from said closing member portion while leaving said connecting portion on said frame portion.

According to another aspect of the present invention, there is provided a cartridge detachably mountable to an image forming apparatus, said cartridge being packed in a packing member; said packing member including a frame portion having a recess for accommodating said cartridge, a closing member portion for openably closing said recess, a hinge portion for movably connecting said closing member portion relative to said frame portion to open and close said recess, a connecting portion connecting said frame portion and said closing member portion to close said recess, and said closing member portion being provided with a separating portion removable from said closing member portion while leaving said connecting portion on said frame portion.

Further features of the present invention will become apparent from the following description of exemplary embodiments with reference to the attached drawings.

DESCRIPTION OF THE PREFERRED EMBODIMENTS

Embodiment 1

Next, referring to FIGS. 2-19, the first embodiment of the present invention is described.

In each of the following embodiments of the present invention, the electrophotographic image forming apparatus is a full-color image forming apparatus which employs four cartridges which are removably installable in the main assembly of the apparatus.

However, the following embodiments are not intended to limit the present invention in scope in terms of the number of cartridges installable in the main assembly of an electrophotographic image forming apparatus (which hereafter will be referred to simply as image forming apparatus). That is, the present invention is also applicable to an image forming apparatus which is different in the number of cartridges it employs, from those in the following embodiments. For example, the present invention is also applicable to a monochromatic image forming apparatus, which employs only one cartridge. Further, the image forming apparatus in each of the following embodiments is a printer. However, these embodiments are not intended to limit the present invention in scope in terms of the type of an image forming apparatus. That is, the present invention is also applicable to other image forming apparatus than those in the following embodiments, for example, a copying machine, a facsimile machine, and the like. Further, the present invention is also applicable to a multifunction image forming apparatus capable of functioning as a copying machine, a facsimile machine, and/or the like.

<General Structure of Image Forming Apparatus>

Figure 2:
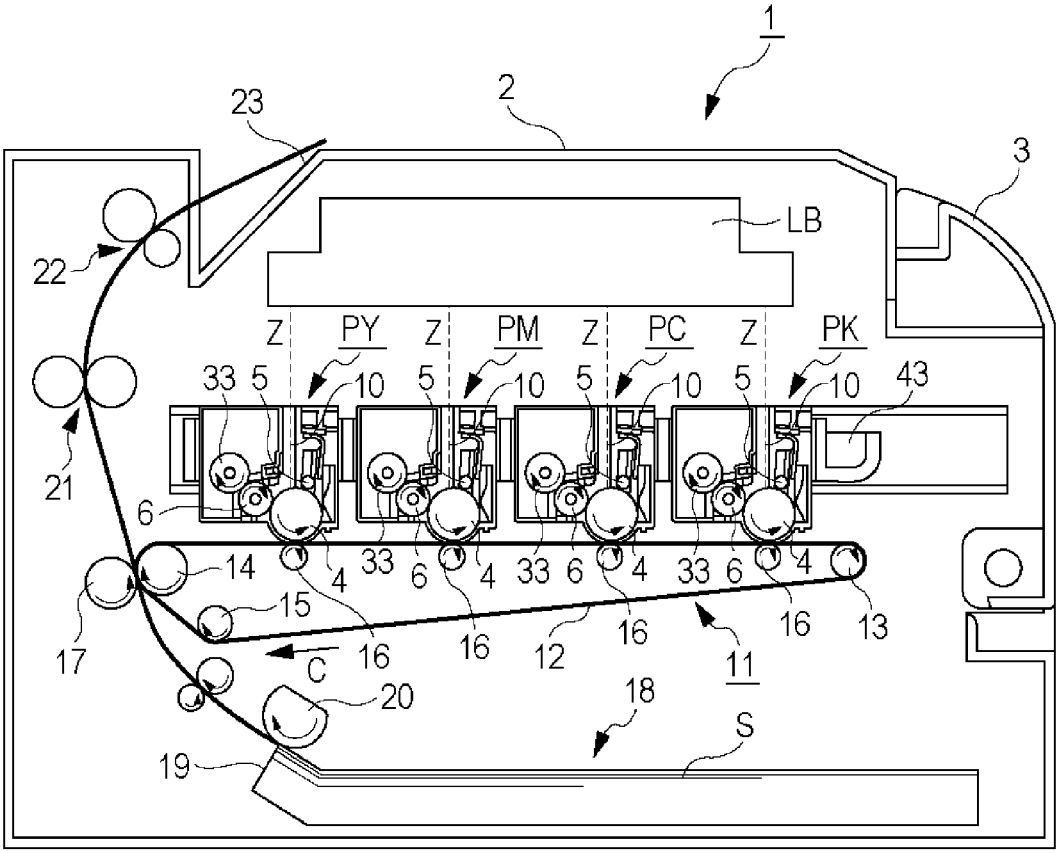
FIG. 2 is a schematic sectional view of the image forming apparatus in the first embodiment, and is for showing the general structure of the apparatus.

FIG. 2 is a schematic sectional view of the image forming apparatus in this embodiment.

Referring to FIG. 2, the image forming apparatus 1 in this embodiment is a full-color laser printer which uses an electrophotographic process. It is based on four primary colors. It is capable of forming a full-color image, as well as a monochromatic image, on a sheet S of recording medium. The image forming apparatus 1 employs a process cartridge system. That is, it is structured so that cartridges can be removably installable in the main assembly 2 of the image forming apparatus 1 (which hereafter may be referred to simply as apparatus main assembly).

Regarding the direction of the image forming apparatus 1, the portion of the apparatus main assembly 2, which has a door 3, is referred to as the front side of the apparatus, and the opposite side from the front side is referred to as the rear side. Further, its right and left sides as seen from the front side are referred to as the drive-side and non-drive side, respectively. The apparatus main assembly 2 is enabled to hold four cartridges (PY, PM, PC and PK), that is, the first cartridge PY, second cartridge PM, third cartridge PC, and fourth cartridge PK, in such a manner that they align in parallel (tandem) in the horizontal direction. The first to fourth cartridges P (PY, PM, PC and PK) are similar in the electrophotographic processing system they possess, but are different in the color of the developer (which hereafter may be referred to as toner) they use. To the first to fourth cartridges P (PY, PM, PC and PK), rotational driving force is transmitted from the driving force outputting portion (unshown) of the apparatus main assembly 2. Further, the first to fourth cartridges P (PY, PM, PC and PK) are supplied with bias voltages (charge bias, development bias, and the like) from the bias source (unshown) of the apparatus main assembly 2 (unshown).

Figure 3:
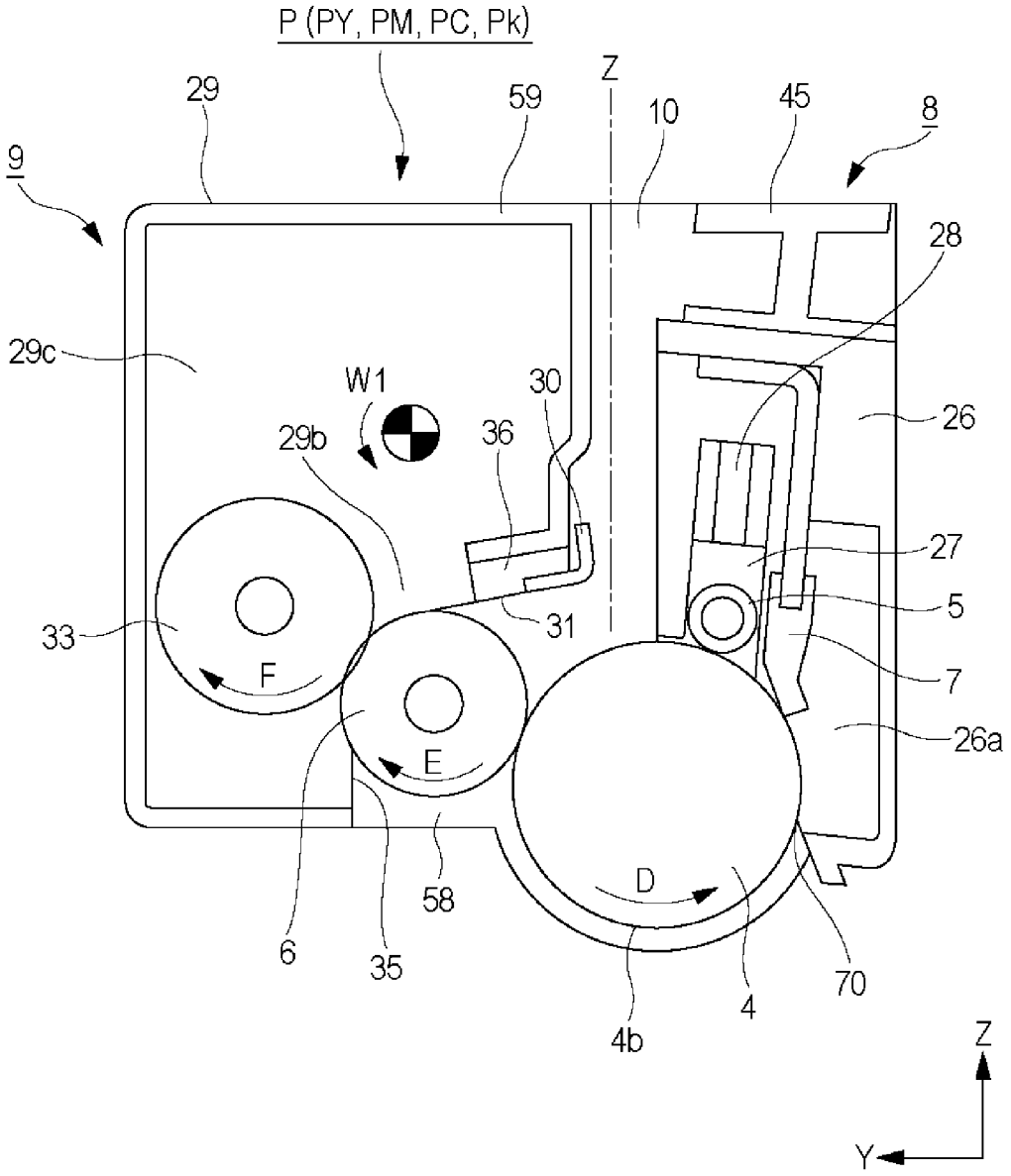
FIG. 3 is a schematic sectional view of the cartridge in the first embodiment, and is for showing the general structure of the cartridge.

Referring to FIG. 3, each of the first to fourth cartridges P (PY, PM, PC and PK) in this embodiment has a first unit which has an electrophotographic photosensitive member 4 (which hereafter will be referred to simply as photosensitive drum 4), a charging means as a means for processing the photosensitive drum 4, and a cleaning means as a means for processing the photosensitive drum 4. Incidentally, the first unit may be referred to as a cleaning unit 8 hereafter. Further, each of the first to fourth cartridge has a second unit 9, which is a developing device having a developing means for developing the electrostatic latent image on the peripheral surface of the photosensitive drum 4. The cleaning unit 8 and developing device 9 are in connection to each other. More concretely, the charging means is a charge roller 5, and the cleaning means is a cleaning blade 7. The developing means is a developer bearing member 6 (which hereafter will be referred to as development roller). The concrete structure of the cartridge will be described later. The first cartridge PY stores yellow (Y) toner in its developing means frame 29. It forms a toner image of yellow color on the peripheral surface of the photosensitive drum 4. The second cartridge PM stores magenta (M) toner in its developing means frame 29. It forms a toner image of magenta color on the peripheral surface of the photosensitive drum 4. The third cartridge PC stores cyan (C) toner in its developing means frame 29. It forms a toner image of cyan color on the peripheral surface of the photosensitive drum 4. The fourth cartridge PK stores black (K) toner in its developing means frame 29. It forms a toner image of black color on the peripheral surface of the photosensitive drum 4.

Referring to FIG. 2, disposed on the top side of the combination of the first to fourth cartridges P (PY, PM, PC and PK) is a laser scanner unit LB as an exposing means. This laser scanner unit LB outputs a beam Z of laser light while modulating the beam Z according to the information of the image to be formed. The beam Z of laser light passes through the exposure window 10 of the cartridge P, and scans (exposes) the peripheral surface of the photosensitive drum 4. Provided on the bottom side of the combination of the first to fourth cartridges P (PY, PM, PC and PK) is an intermediary transfer belt unit 11 as a transferring member. This intermediary transfer belt unit 11 has a driver roller 13, a turn roller 14, and a tension roller 15. It has also a flexible transfer belt 12 which is suspended and kept stretched by these rollers 13, 14 and 15. The photosensitive drum 4 in each of the first to fourth cartridges P (PY, PM, PC and PK) is in contact with the top surface of the transfer belt 12, by its downwardly facing portion. The area of contact between the photosensitive drum 4 and transfer belt 12 is the primary transfer portion. There is a primary transfer roller 16 on the inward side of the loop (belt loop) which the transfer belt 12 forms. The primary transfer roller 16 is positioned so that it opposes the exposed portion 4*b* of the photosensitive drum 4. Further, the image forming apparatus 1 is provided with a secondary transfer roller 17, which is kept pressed against the turn roller 14, with the presence of the transfer belt 12 between itself and turn roller 14. The area of contact between the transfer belt 12 and secondary transfer roller 17 is the second transfer portion. Located on the bottom side of the intermediary transfer unit 11 is a recording medium conveyance unit 18, which has a sheet feeder tray 19 in which a substantial number of sheets S of recording medium are stored in layers, and a sheet feeder roller 20. Further, there are a fixation unit 21 and a discharge unit 22, in the top left portion of the apparatus main assembly 2. A part of the top surface of the apparatus main assembly 2 is utilized as a delivery tray 23. To a sheet S of recording medium, a toner image is fixed by the fixing means in the above described fixation unit 21. Then, the sheet P is discharged into the above-mentioned delivery tray 23.

<Image Forming Operation>

The operation to be carried out by the image forming apparatus 1 in this embodiment to form a full-color image is as follows.

The photosensitive drum 4 in each of the first to fourth cartridges P (PY, PM, PC and PK) is rotationally driven at a preset speed (in direction indicated by arrow mark D in FIG. 3; counterclockwise in FIG. 2). The transfer belt 12 also is rotationally (circularly) driven at a speed which corresponds to the speed of the photosensitive drum 4, in such direction that the peripheral surface of the photosensitive drum 4 and the transfer belt 12 move in the same direction (indicated by arrow mark C in FIG. 2), in the primary transfer portion. The laser scanner unit LB also is driven. In synchronism with the driving of the laser scanner unit LB, the peripheral surface of the photosensitive drum 4 is charged by the charge roller 5 to a preset polarity and potential level, in each of the cartridges P. Then, the charged portion of the peripheral surface of the photosensitive drum 4 is scanned by (exposed to) the beam Z of laser light emitted by the laser scanner unit LB while being modulated with image formation signals. Consequently, an electrostatic latent image which reflects the image formation signals which corresponds to one of the four monochromatic primary color images, into which the image to be formed has been separated, is effected on the peripheral surface of the photosensitive drum 4. Then, the electrostatic latent image is developed by the development roller 6 which is being rotationally driven at a reset speed (in direction indicated by arrow mark E in FIG. 3; clockwise direction in FIG. 2).

Through an electrophotographic process such as the one described above, a toner image of yellow color, which corresponds to the yellow component of the full-color image, is formed on the peripheral surface of the photosensitive drum 4 in the first cartridge PY. Then, the yellow toner image comes into contact with the primary transfer roller 16, in the area in which the primary transfer roller 16 is pressed against the exposed portion 4*a* of the photosensitive drum 4, with the presence of the transfer belt 12 between itself and photosensitive drum 4. Consequently, the yellow toner image is transferred (primary transfer) onto the transfer belt 12. Similarly, a toner image of magenta color, which corresponds to the magenta components of the full-color image is formed on the photosensitive drum 4 in the second cartridge PM. This toner image is transferred (primary transfer) onto the transfer belt 12 in such a manner that it is layered upon the yellow toner image which has just been transferred onto the transfer belt 12. Similarly, a toner image of cyan color, which corresponds to the cyan components of the full-color image is formed on the photosensitive drum 4 in the third cartridge PC. This toner image is transferred (primary transfer) onto the transfer belt 12 in such a manner that it is layered upon the yellow and magenta toner images which have just been transferred onto the transfer belt 12. Similarly, a toner image of black color, which corresponds to the black components of the full-color image is formed on the photosensitive drum 4 in the fourth cartridge PK. This toner image is transferred (primary transfer) onto the transfer belt 12 in such a manner that it is layered upon the yellow, magenta, and cyan toner images which have just been transferred onto the transfer belt 12. As a result, unfixed yellow, magenta, cyan, and black toner images are formed in layers on the transfer belt 12.

Meanwhile, the sheets S of recording medium in the sheet feeder tray 18 are fed into the apparatus main assembly 2 with a preset control timing, while being separated one by one. Then, each sheet S of recording medium is introduced into the secondary transfer portion, which is the area of contact between the secondary transfer roller 17 and transfer belt 12, with a preset control timing. Thus, while the sheet S is conveyed through the secondary transfer portion, the four toner images, different in color, on the transfer belt 12 are transferred onto the surface of the sheet S as if they are peeled away from the surface of the transfer belt 12.

<Cartridge Structure>

Figure 4:
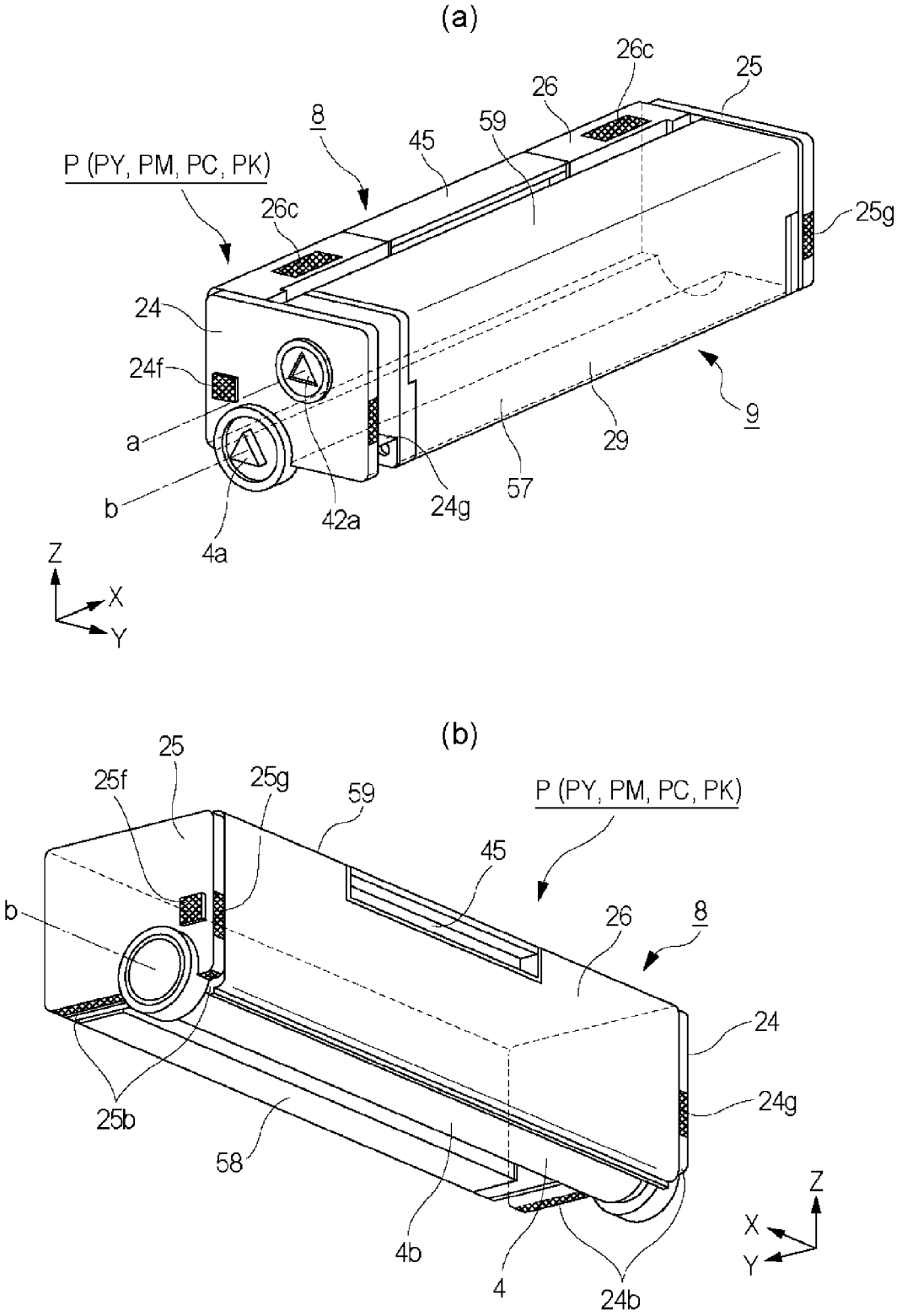
FIG. 4 is a schematic perspective view of the cartridge in the first embodiment, and is for showing the general structure of the cartridge.

FIGS. 4(*a*) and 4(*b*) are perspective views of the cartridge P (PY, PM, PC and PK) in this embodiment, which are different in the angle of view. The cartridges P (PY, PM, PC and PK) are the same in structure. Therefore, in the following description of the cartridges PY, PM, PC and PK, the cartridges will be referred to simply as cartridges P, or cartridge P.

The cartridge P is roughly in the form of a long and narrow rectangular parallelepiped, and its long edges are in parallel to the direction of the rotational axis b of the photosensitive drum 4. It has the cleaning unit 8, the developing device 9, a drive-side cover 24, and a non-drive-side cover 25. FIG. 4(*a*) is a perspective view of the cartridge P as seen from the non-drive side. The cartridge P is made up of the cleaning unit 8 and development unit 9 (developing device), and is structured so that the driver side cover 24 and non-drive side cover 25, which are fixed to the cleaning unit 8 are rotatable about the pivot line (single-dot chain line in FIG. 4(*a*)) of the developing device 9. The developing device 9 is under the pressure generated by springs or the like in a preset direction (indicated by arrow mark W1 in FIG. 3). The detail of this setup will be described later. Referring to FIG. 3, the cleaning unit 8 has: a cleaning means container which holds the photosensitive drum 4, the charge roller 5, and a cleaning blade 7; and a handhold 45. Next, referring to FIGS. 4(*a*) and 4(*b*), the photosensitive drum 4 is rotatably supported by the drive-side cover 24 and non-driven-side cover 25, and is rotationally driven (in direction indicated by arrow mark D in FIG. 3) by the driving force transmitted to the photosensitive drum 4 by way of a drum driving coupling 4*a*. Referring again to FIG. 3, the charge roller 5 is rotatably supported by a pair of charge roller bearings 27 of the cleaning means container 26, by its lengthwise ends. It is in contact with the peripheral surface of the photosensitive drum 4, and is rotated by the rotation of the photosensitive drum 4. It charges the peripheral surface of the photosensitive drum 4 by being supplied with charge bias. In order to uniformly charge the peripheral surface of the photosensitive drum 4, the lengthwise ends of the charge roller 5 are kept pressed upon the peripheral surface of the photosensitive drum 4 by a pair of charge roller pressing compression springs 28. The cleaning blade 7 is fixed to the cleaning means container 26, in contact with the photosensitive drum 4, in such an attitude that its cleaning edge formed of elastic rubber is on the upstream side of its base portion in terms of the rotational direction (indicated by arrow mark D in FIG. 3) of the photosensitive drum 4. It scrapes away the transfer residual toner, that is, the toner remaining on the peripheral surface of the photosensitive drum 4 after the primary transfer, to clean the peripheral surface of the photosensitive drum 4, during an image forming operation. In order to ensure that the transfer residual toner is completely scraped away, the cleaning blade 7 is kept pressed upon the peripheral surface of the photosensitive drum 4 so that a preset amount of pressure is maintained between the cleaning edge of the cleaning blade 7 and the peripheral surface of the photosensitive drum 4. After the transfer residual toner is scraped away from the peripheral surface of the photosensitive drum 4 by the cleaning blade 7, it is stored as waste toner in waste toner storage 26*a* of the cleaning means container 26. Thus, in order to prevent the waste toner from leaking out of the waste toner storage 26*a* through the gap between the photosensitive drum 4 and waste toner storage 26*a* and the gap between the cleaning blade 7 and waste toner storage 26*a*, a waste toner recovery sheet 70 is fixed to the waste toner storage 26*a* in such an attitude that it extends in the lengthwise direction of the photosensitive drum 4. Further, there are provided a pair of cleaning blade end seals (unshown) at the lengthwise ends of the cleaning blade 7, one for one. The handhold 45 is the portion by which the cartridge P should be held by a user. It is formed as an integral part of the cleaning means container 26, or is independently formed from the cleaning means container 26 and then, is attached to the cleaning means container 26. However, in a case where the attitude in which the cartridge P is installed into, or removed from, the apparatus main assembly 2, which will be described later, is different from that in this embodiment because of the difference in the structure of the image forming apparatus 1, the cartridge P may be structured so that the handhold 45 becomes a part of the developing means container 29.

In this embodiment, the cartridge P is roughly in the form of a rectangular parallelepiped. The surface 58, or one of the six surfaces, of the cartridge P, has an exposure opening 4*b* for transferring the toner image on the peripheral surface of the photosensitive drum 4, onto the intermediary transfer belt unit 11 as described above. The surface 59, which is the opposite surface from the surface 58, has the above described handhold 45. Next, referring to FIGS. 4(*a*) and 4(*b*), the cartridge P has portions by which the cartridge P is regulated in its position in the cartridge package 46 after the enclosing of the cartridge P in the cartridge package 46. More concretely, the portions of the cartridge P, by which the cartridge P is regulated in position are first regulatory portions 24*f* and 25*f*, second regulatory portions 24*b*, 25*b* and 26*c*, and third regulatory portions 24*g* and 25*g*. The first regulatory portions 24*f* and 25*f* are used to regulate the cartridge P in position in terms of the lengthwise direction (indicated by arrow mark X in drawings) of the cartridge package, which is parallel to the axial line of the photosensitive drum 4 in the cartridge P. The second regulatory portions 24*b*, 25*b*, and 26*c* are used to regulate the cartridge P in position in terms of the direction (direction Z, hereafter) parallel to the normal line of the surface 59 of the cartridge P, which is perpendicular to the direction X. The third regulatory portions 24*g* and 25*g* are used to regulate the cartridge P in position in terms of the direction (direction Y, hereafter), which is perpendicular to both the directions X (parallel to lengthwise direction of cartridge P) and Z. The positional regulation of the cartridge P, in the cartridge package 46, with the use of each of the above-described regulatory portions, will be described later in detail.

<Structural Configuration for Installation and Removal of Cartridge>

Next, the operation for installing the cartridge P into the apparatus main assembly 2, and the operation for removing the cartridge P from the apparatus main assembly 2, are described.

Figure 5:
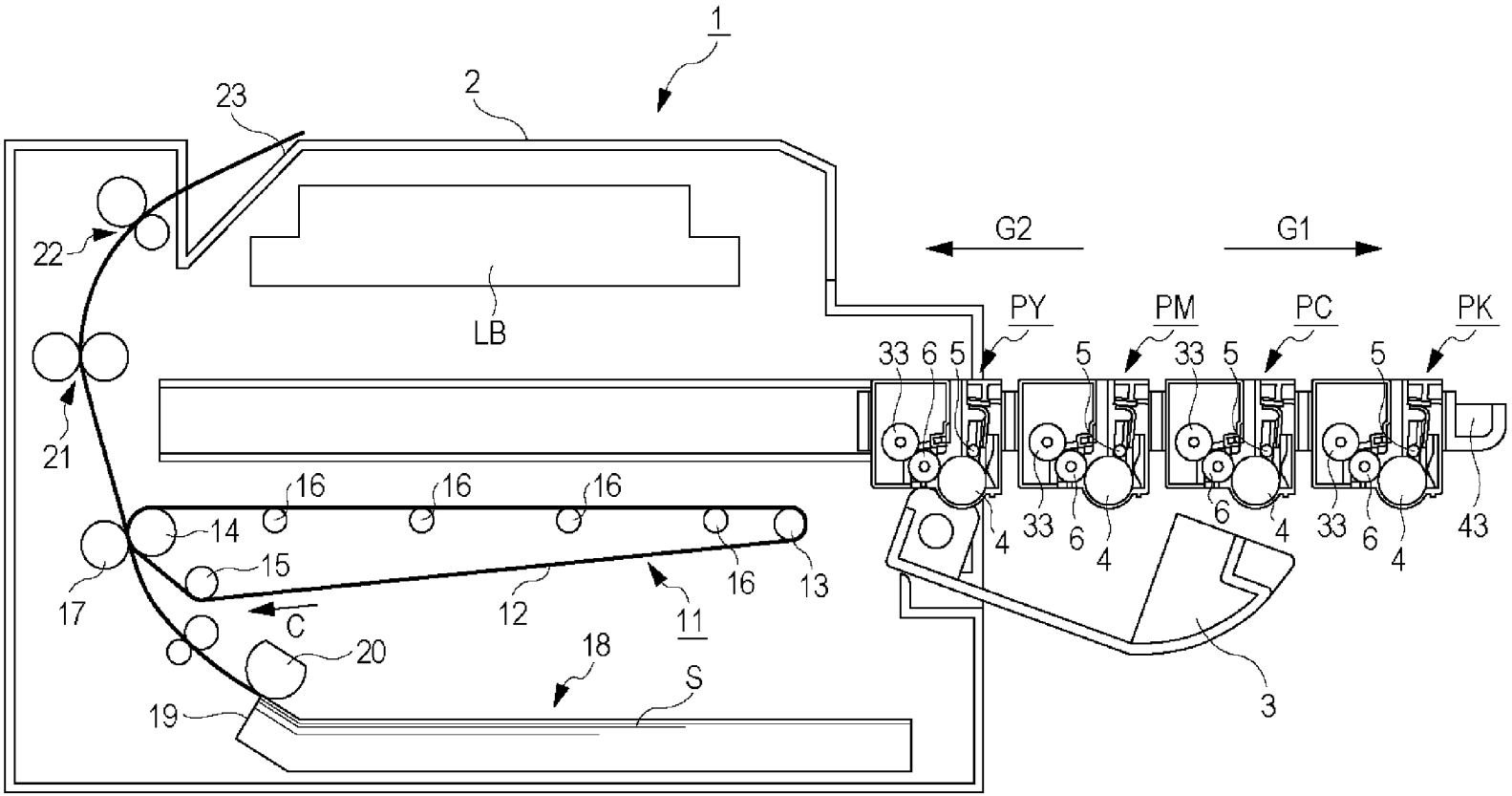
FIG. 5 is a schematic sectional view of the image forming apparatus in the first embodiment, when the apparatus is in the state in which the cartridges are movable into, or out of, the main assembly of the apparatus.
Figure 6:
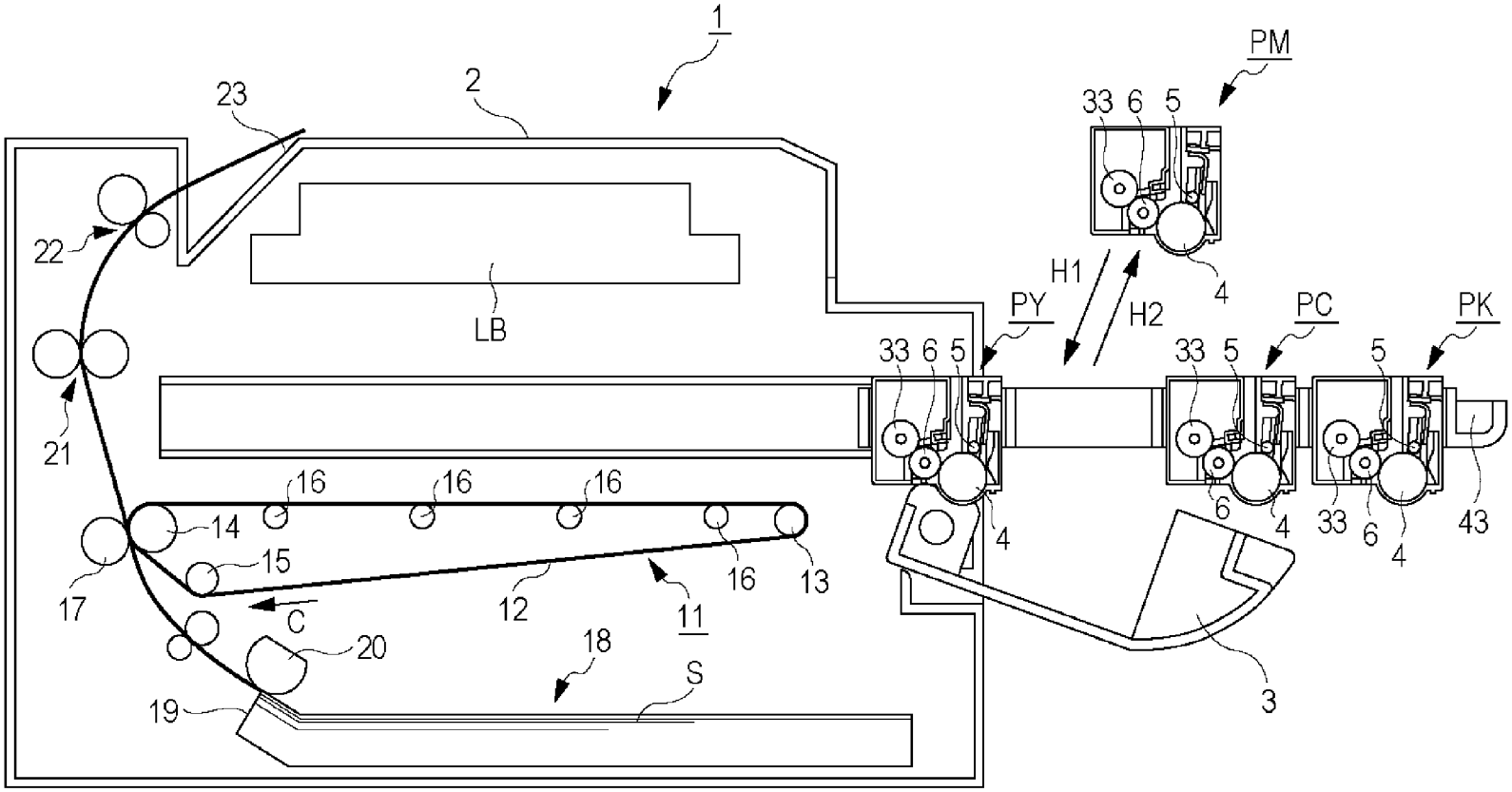
FIG. 6 is a schematic sectional view of the image forming apparatus in the first embodiment, and is for showing the operation for placing the cartridge into, or removing the cartridge from, the cartridge tray of the main assembly of the apparatus.

FIG. 5 is a schematic sectional view of the apparatus main assembly 2 and cartridges P, when the cartridge tray 43 is out of the apparatus main assembly 2, and therefore, the cartridges P can be installed into, or removed from, the cartridge tray 43. FIG. 6 is also a schematic sectional view of the apparatus main assembly 2 and cartridges P, when the cartridge tray 43 is out of the apparatus main assembly 2. It shows how the cartridges P can be installed into, or removed from, the cartridge tray 43. Referring to FIG. 5, the apparatus main assembly 2 is provided with the cartridge tray 43 into which the cartridges P are installable, and from which the cartridges P are removable. The apparatus main assembly 2 is structured so that the cartridge tray 43 can be linearly moved relative to the apparatus main assembly 2 (pulled out of, or pushed into, apparatus main assembly 2) in directions G1 or G2, which is practically horizontal). Further, the apparatus main assembly 2 is structured so that the cartridge tray 43 can be locked into the image formation position which is in the apparatus main assembly 2, and the cartridge installation-removal position which is outside the apparatus main assembly 2.

First, the operation for installing the cartridge P into the apparatus main assembly 2 is described.

As the door 3 of the apparatus main assembly 2 is opened, and the cartridge tray 43 is moved in the direction indicated by the arrow mark G2 in FIG. 5, the cartridge tray 43 is moved into the cartridge installation-removal position. While the cartridge tray 43 is in the state shown FIG. 5, the cartridge P can be installed into the cartridge tray 43 from the direction indicated by an arrow mark H1 in FIG. 6, and can be held in the cartridge tray 43. Then, as the cartridge tray 43, which is holding the cartridges P, is to be moved in the direction indicated by the arrow mark G2 in FIG. 5 to be placed in the image formation position in the apparatus main assembly 2. Then, the door 3 is to be closed, to complete the operation for installing the cartridges P into the apparatus main assembly 2. Next, the operation for removing the cartridges P from the apparatus main assembly 2 is described. First, the cartridge tray 43 is to be moved into the cartridge installation-removal position as it is moved by the above-described operation for installing the cartridges P, into the apparatus main assembly 2. While the cartridge tray 43 is in the state shown in FIG. 5, the cartridge P (cartridges P) can be removed from the cartridge tray 43 in the direction indicated by an arrow mark H2 in FIG. 6, to end the operation for removing the cartridge P (cartridges P) from the apparatus main assembly 2. That is, the image forming apparatus 1 is structured so that the cartridge P (cartridges P) can be installed into, or removed from, the apparatus main assembly 2 through the above described operations. The process for removing the cartridge P from the cartridge package 46, and installing the cartridge P into the apparatus main assembly 2, will be described later in detail.

<Structure of Developing Device>

Figure 7:
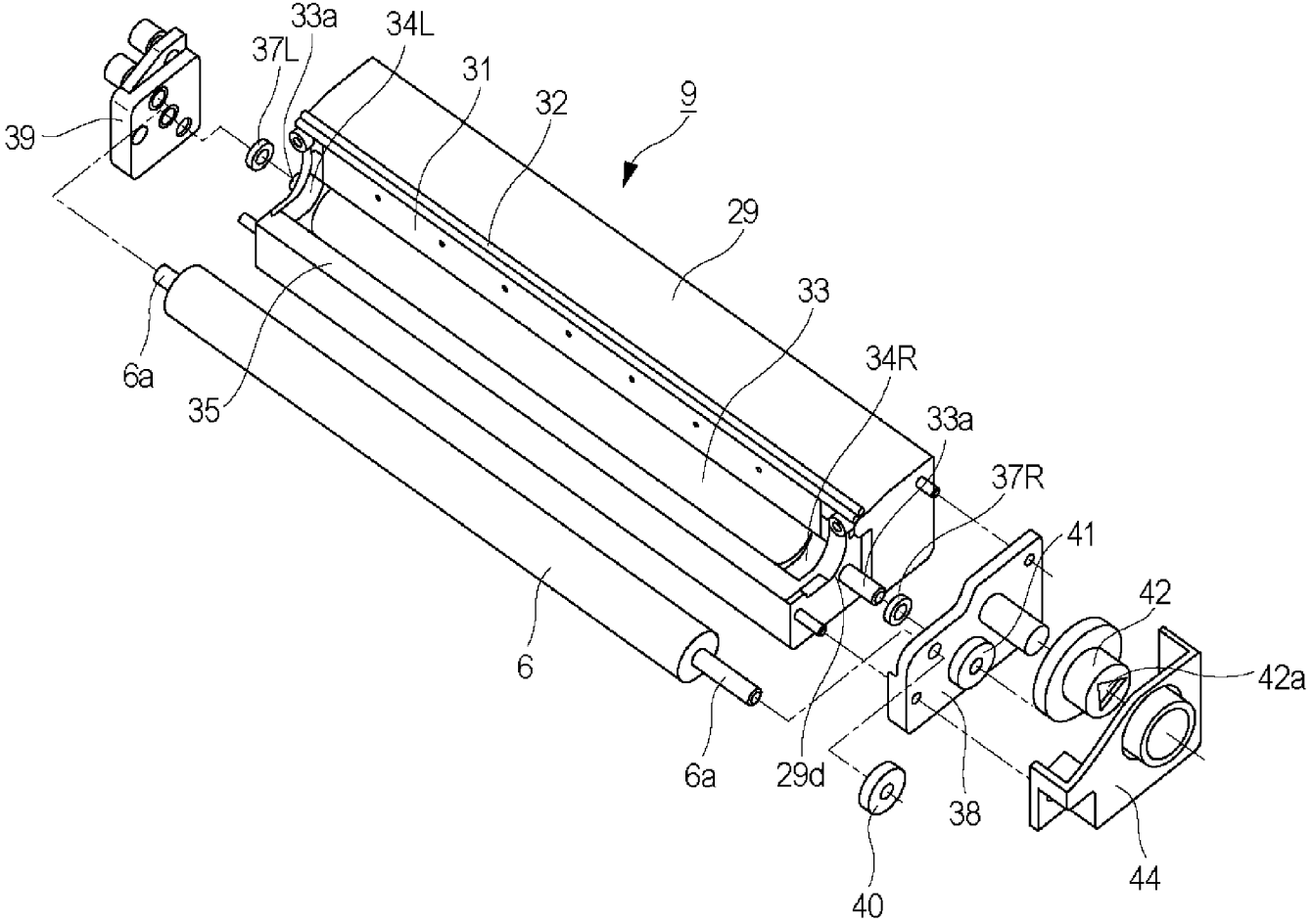
FIG. 7 is a schematic exploded perspective view of the developing device in the first embodiment.

Referring to FIGS. 3 and 7, the shape of the developing device 9 is such that the lengthwise direction of the developing device 9 is parallel to the axial line of its development roller 6. The developing device 9 is made up of the developing means frame 29, the development blade 31, a developer supply roller 33, a pair of end seals 34R and 34L, the flexible sheet 35, and a pair of end seals 37R and 37R for the developer supply roller, in addition to the development roller 6 (FIG. 7). Further, the developing means frame 29 is provided with a toner storage chamber 29*c* for storing toner, and also, an opening 29*b* for discharging toner from the toner storage chamber 29*c*, as shown in FIG. 3.

Development roller 6 and developer supply roller 33 are positioned in the adjacencies of the opening 29*b* of the developing means frame 29. Further, referring to FIG. 7, the lengthwise ends of the core 6*a* of the development roller 6 are supported by a pair of bearings, more specifically, a drive-side bearing 38 and non-drive-side bearing 39, attached to the lengthwise end surfaces of the developing means frame 29, one for one. Further, the drive-side end of the core 6*a* of the development roller 6, and the drive-side end of the developer supply roller 33, are fitted with a development roller gear 40 and developer supply roller gear 41, respectively, which are in engagement with a driving force input gear 42 for driving the developing device 9. The driving force input gear 42 is provided with a coupling 42*a*, which engages with the driving force output coupling (unshown) of the apparatus main assembly 2, to enable the driving force of the motor (unshown) of the apparatus main assembly 2, to be transmitted to the developing device 9. The development roller 6 and developer supply roller 33 are rotationally driven at a preset speed. The development blade 31 is a piece of thin and elastic metallic plate. It is placed in contact with the peripheral surface of the development roller 6 in such an attitude that its free edge (developer regulating edge) is on the upstream side of the base portion of the development blade 31, in terms of the rotational direction (indicated by arrow mark E in FIG. 3) of the development roller 6.

Referring to FIG. 7, the end seals 34R and 34L are placed at the lengthwise ends of the opening of the developing means frame 29, one for one. They prevent toner from leaking through the gap between the development blade 31 and developing means frame 29, and also, the gap between the development roller 6 and developing means frame 29. The flexible sheet 35 is disposed so that it extends in the lengthwise direction of the development blade 31, and contacts the development roller 6 on the opposite side from the development blade 31. It prevents toner from leaking through the gap between the developing means frame 29 and development roller 6. Further, the developer supply roller shaft seals 37R and 37L are attached to the portions of the core 33*a* of the developer supply roller 33, which are exposed outward from the developing means frame 29. They prevent toner leaking through the gap between the wall of the hole of the developing means frame 29, through which the core 33*a* of the developer supply roller 33 is put, and the core 33*a*.

The developing device 9 is always kept under the pressure generated by a pair of compression springs (unshown) in the direction (indicated by arrow mark W1 in FIG. 3) to pivotally move the developing device 9 about the pivot line (axial line a) shown in FIG. 4. Thus, the development roller 6 remains in contact with the photosensitive drum 4. During an image forming operation, driving of the developing device 9 causes the developer supply roller 33 and development roller 6 to rotate while rubbing each other, whereby the toner in the developing means frame 29 is borne on the development roller 6. The development blade 31 regulates in thickness the toner layer on the peripheral surface of the photosensitive drum 4 as the toner layer is formed on the peripheral surface of the development roller 6. Further, it frictionally charges the toner between itself and development roller 6 by the contact pressure it generates between itself and development roller 6. Thus, the charged toner particles on the development roller 6 adhere to the electrostatic latent image on the photosensitive drum 4, developing thereby the latent image into a visible image.

<Structure of Cartridge Package>

Next, referring to FIGS. 1, 8, 9 and 10, the structure of the cartridge package 46 is described.

Figure 1:
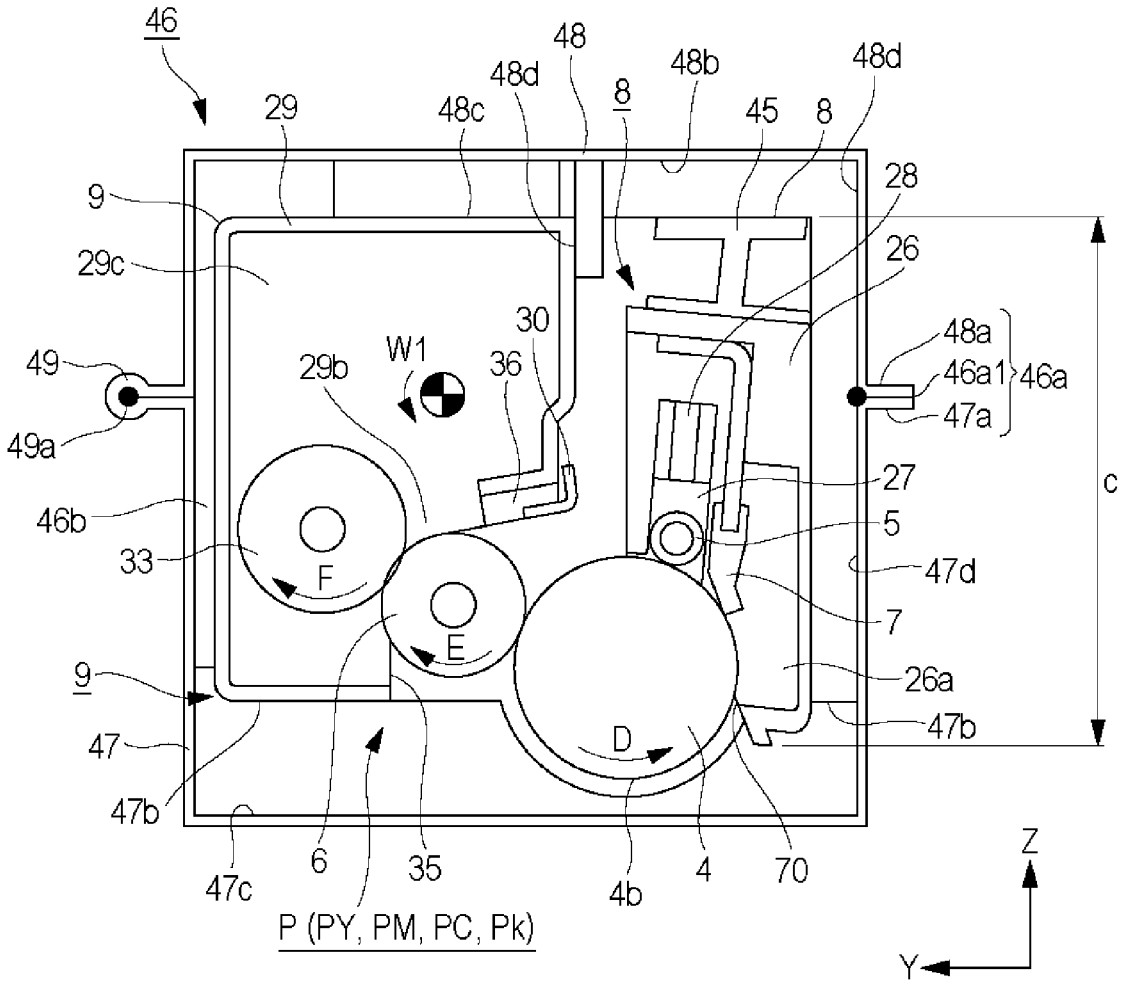
FIG. 1 is a schematic sectional view of the combination of the cartridge and cartridge package in the first embodiment of the present invention, when the cartridge is in the cartridge package.
Figure 8:
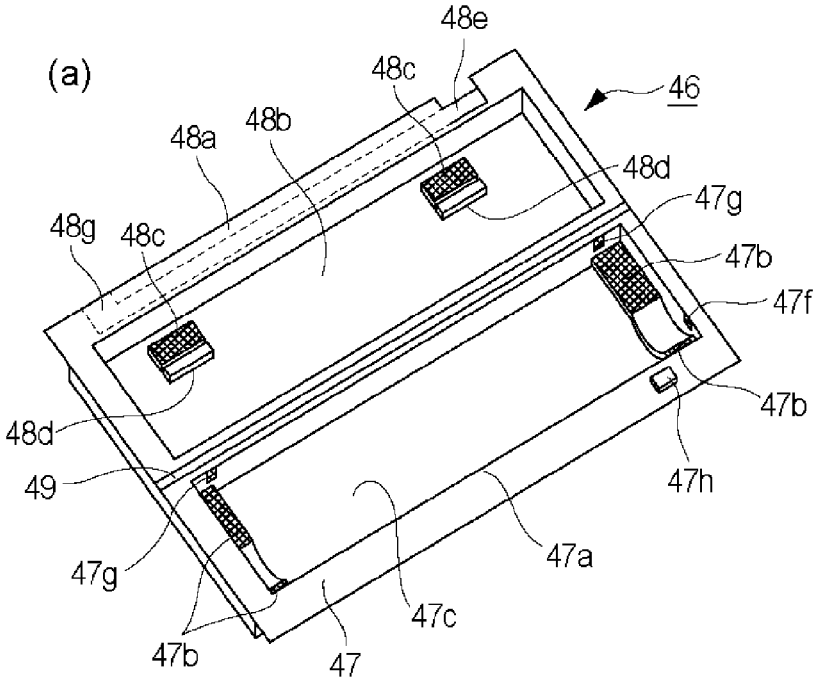
FIG. 8 is a schematic perspective view of the cartridge package in the first embodiment, which is in the state in which a cartridge is removable from the package.
Figure 8:
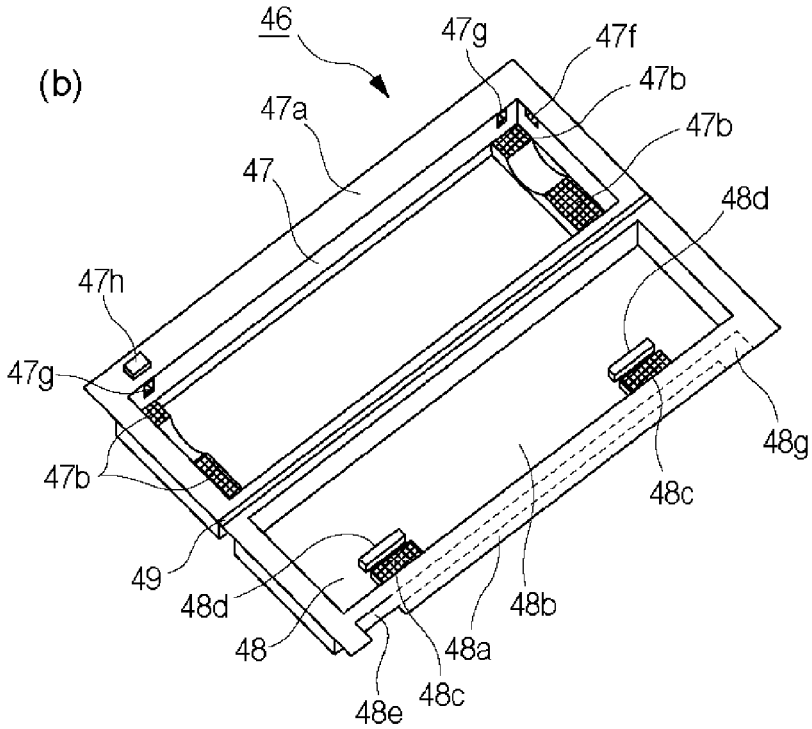
Figure 9:
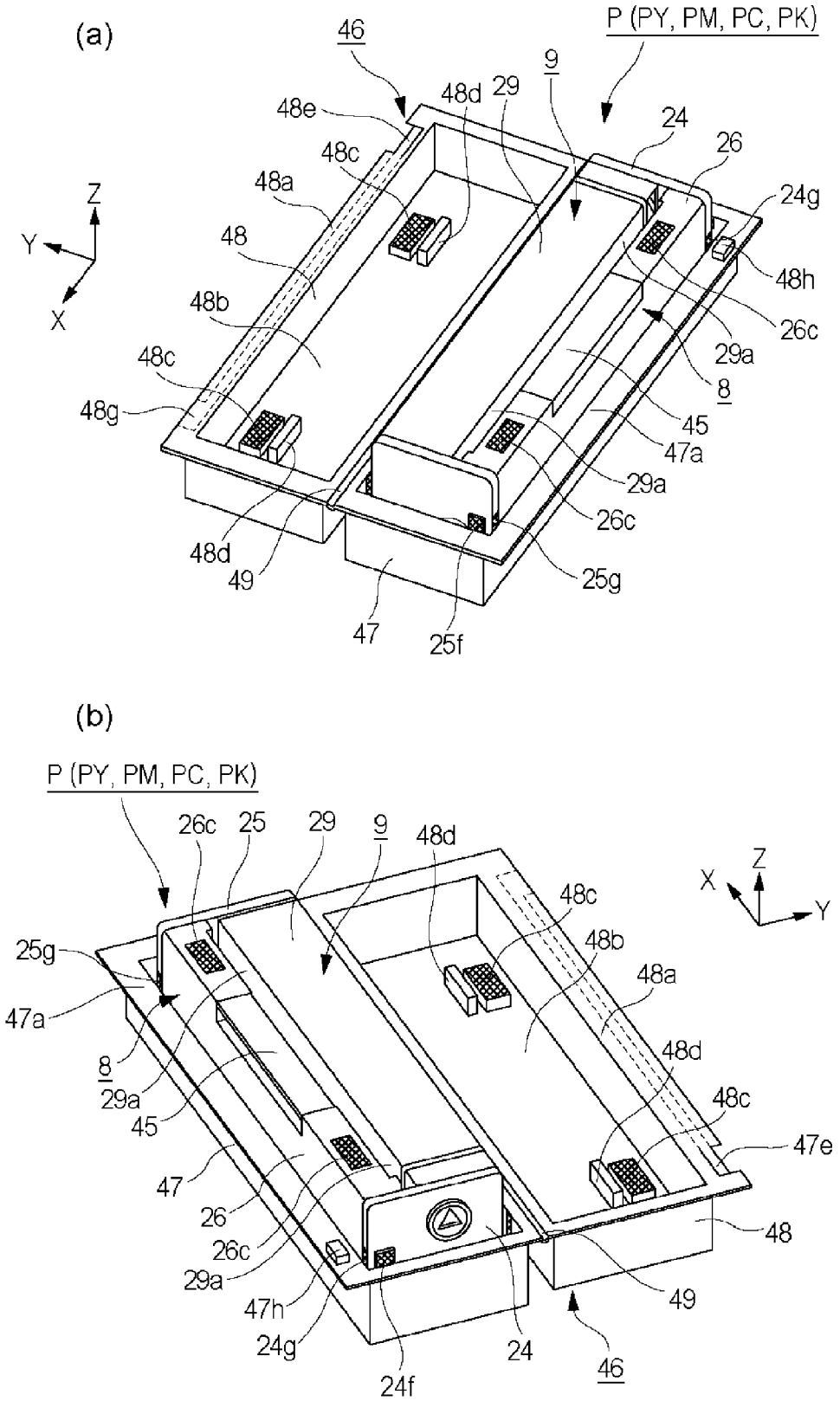
FIG. 9 is a schematic perspective view of a combination of the cartridge package and the cartridge therein, in the first embodiment, which is in the state in which the cartridge is removable from the package.
Figure 10:
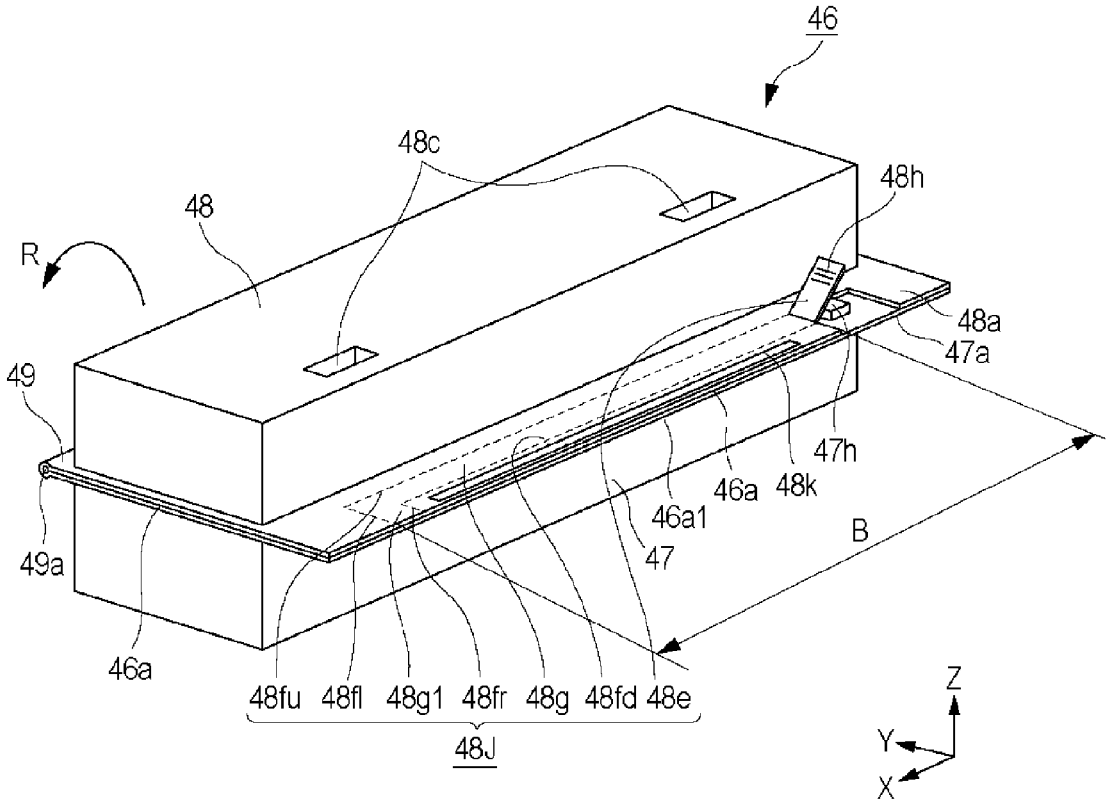
FIG. 10 is a schematic perspective view of the cartridge package in the first embodiment, in which a cartridge is present, and which has not been opened.

FIG. 1 is a schematic sectional view of the cartridge P and cartridge package 46, when the cartridge P is remaining enclosed in the package 46. FIGS. 8(*a*) and 8(*b*) are schematic perspective views of the cartridge package 46 in accordance with the present invention, when the package 46 is in the state in which the cartridge P can be simply removed from the package 46. FIGS. 8(*a*) and 8(*b*) are different only in the angle of view. FIGS. 9(*a*) and 9(*b*) are schematic perspective view of the cartridge P and cartridge package 46 in accordance with the present invention, when the cartridge P and cartridge package 46 are in the state in which the cartridge P can be simply removed from the cartridge package 46. FIGS. 9(*a*) and 9(*b*) are different only in the angle of view. Here, the lengthwise direction of the cartridge package 46 is the same as the lengthwise direction (indicated by arrow mark X in drawings) of the cartridge P when the cartridge P is in the cartridge package 46. FIG. 10 is a schematic perspective view of the cartridge package 46 after the proper placement of the cartridge package 46 in the package 46 and the sealing (closing) of the package 46.

Referring to FIGS. 8(*a*) and 8(*b*), the cartridge package 46 is made up of top and bottom portions, and hinge portion, which hereafter will be referred to as a frame 47, a lid 48 and hinge 49. The frame 47 and lid 48 are rotationally movable relative to each other about the pivot line 49*a* (FIG. 1) of the hinge 49. The frame 47, lid 48 and hinge 49 of the cartridge package 46 are formed of polyethylene-terephthalate, polypropylene, or the like, for example. As for the method for forming these components of the cartridge package 46, vacuum forming, pressure forming, vacuum-pressure forming, molding, pressure molding, draw molding, injection molding, or the like can be used. Vacuum forming is a method for molding a heated sheet of resin into a preset shape by suctioning out the air between the sheet and a mold. The pressure forming is a method for molding a heated sheet of resin into a preset shape by pressing the sheet against a mold with the use of compressed air. Vacuum-pressure forming is a method for molding a heated sheet of resin into a preset shape with the use of both vacuum forming and pressure forming. Further, draw molding is a method which places a heated sheet of resin in a female mode, and presses a male mold into the female mold to compress the sheet to mold the sheet into a preset shape. Injection molding is a method for molding melted resin into a preset shape by injecting the melted resin into the space formed by female and male molds. Vacuum forming and pressure forming are lower in the cost for forming the components of the cartridge package 46 and cartridge P. However, they are likely to be inferior to the draw molding and injection molding, in accuracy in terms of the measurements of a finished product than draw molding and injection molding. But, vacuum-pressure forming is superior to the vacuum forming or pressure forming in accuracy in terms of component measurement. Therefore, using vacuum-pressure forming can reduce manufacturing cost while keeping lower the cartridge package and/or cartridge in manufacture cost. Referring to FIG. 8, the frame 47 has a first recessed portion 47*c*, which is roughly U-shaped in cross-section, whereas the lid 48 has a second recessed portion which also is roughly U-shaped in cross-section. The lid 48 can completely cover or expose the first recessed portion 47C. The frame 47 and lid 48 have flat flanges 47*a* and 48*a*, which surround the top edges of the first and second recessed portions 47*a* and 48*a*, respectively. The lid 48 is connected to the frame 47 by the hinge 49 in such a manner that the lid 48 is pivotally movable about the pivot line 49*a* of the hinge 49 to cover or expose the first recessed portion 47*c*. In this embodiment, the lid 48, frame 47, and hinge 49 are integrally formed. However, this embodiment is not intended to limit the present invention in scope in terms of the method for forming the cartridge package 46. That is, the frame 47 and lid 48 may be separately formed, and then, be connected later.

Next, the fixation of the cartridge P to the cartridge package 46 is described.

Referring to FIGS. 9(*a*) and 9(*b*), the cartridge P is supported by the frame 47 of the cartridge package 46, in the first state shown in FIGS. 9(*a*) and 9(*b*). The details of the support will be described later. Here, the first state is such a state that the cartridge P is simply removable from the frame 47 as shown in FIGS. 9(*a*) and 9(*b*). Further, it is a state in which the cartridge P is held in the frame 47, and the photosensitive drum exposing portion 4*b* (FIG. 4(*b*)) of the cartridge P remains covered with the frame 47. In this state, in terms of the direction Z in the drawings, the handhold 45 of the process cartridge P is on the lid 48 side of the flanges 47*a* and 48*a*, by which the frame 47 and lid 48 are placed fully in contact with each other. Also in terms of the direction Z in the drawings, the photosensitive drum exposing portion 4*b* is on the frame 47 side of the flanges 47*a* and 48*a*, by which the frames 47 and lid 48 are placed fully in contact with each other to enclose the cartridge P. Also in this state or the first state, the cartridge P is in such an attitude that the drum exposing portion 4*b* of the cartridge P is not in contact with the frame 47, and a user can grasp the handhold 45 of the cartridge P.

Next, while the cartridge package 46 and cartridge P are in the state shown in FIGS. 9(*a*) and 9(*b*), the lid 48 is to be rotationally moved about the pivot line 49*a* (FIG. 1) of the hinge 49, in order to make the flange 47*a* of the frame 47 and the flange 48*a* of the lid 48 to squarely face each other. Then, the flange 47*a* of the frame 47 and the flange 48*a* of the lid 48, which are squarely facing each other, are joined across the joint 48*k*. The joint 48*k* will be described later in detail. Consequently, the first recessed portion 47*c* of the frame 47 and the second recessed portion 48 of the lid 48 are joined to each other across the flanges 47*a* and 48*a*, creating thereby a cartridge storage space 46*b*, on the inward side of the frame 47 and lid 48, as shown in FIG. 1. In other words, the state of the cartridge package 46 is changed to the second state in which the cartridge P can be contained in the cartridge storage space 46*b* (FIG. 10). In this state, the cartridge P is entirely or partly covered by the second recessed portion 48*b* of the lid 48, in such a manner that the recess portion 48*b* of the lid 48 faces the handhold portion 47 of the cartridge P which is roughly in the form of a rectangular parallelepiped. The flange 48*a* has an unsealing portion 48J (FIG. 10), which is on the opposite side of the lid 48 from the hinge 49, in term of the direction Y. A user is to unseal the cartridge package 46 by removing the unsealing portion 48J. This operation will be described later in detail. Through the above described process for packaging the cartridge P, the cartridge P is entirely covered by the frame 47 and lid 48; the cartridge P is packaged for transportation (FIGS. 1 and 10).

When the cartridge P and cartridge package 46 are in the state (second state) in which the cartridge P remains enclosed (sealed) in the cartridge package 46, the cartridge package 46 supports the first regulatory portion 25*f*, second regulatory portions 24*b*, second regulatory portion 26*c*, and third regulatory portion 25*g* of the cartridge P, by its first regulatory portion 47*f*, second regulatory portion 47*b* and 48*c*, and third regulatory portion 47*g*. That is, the cartridge package 46 and cartridge P are not fully in contact with each other, that is, except for the abovementioned portions. Therefore, as vibrations and/or impacts occur during cartridge transportation, the portions of the cartridge package 46 other than the abovementioned portions elastically or permanently deform to absorb the vibrations and/impacts. In other words, the cartridge package 46 functions as a cartridge protecting means which prevents the vibrations and/impacts which occur during cartridge transportation, from being directly transmitted to the photosensitive drum 4 and processing means.

<Relationship between Handhold and Cartridge Package 46>

Figure 11:
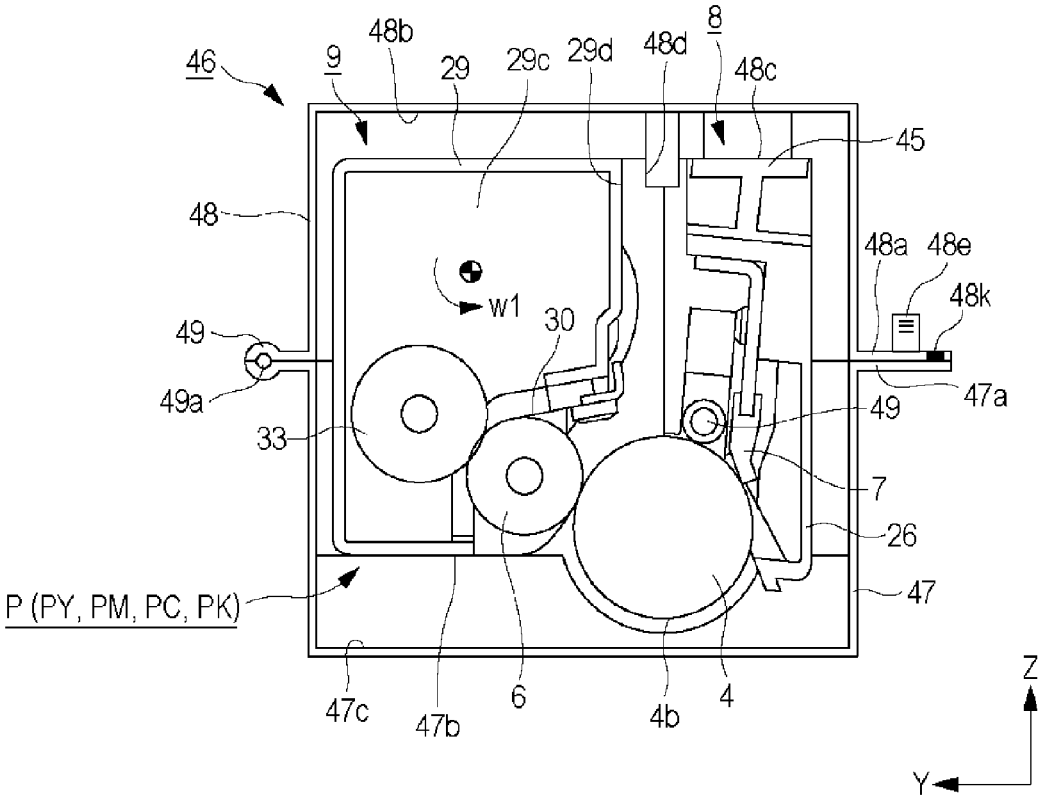
FIG. 11 is a schematic sectional view of the cartridge package in the first embodiment, in which a cartridge is present, and which has not been opened.

Next, referring to FIG. 11, the relationship between the handhold 45 of the cartridge P and the cartridge package 46 is described. The cartridge P is provided with the handhold 45 which is a part of the cleaning unit 8. The cartridge P is enclosed by the cartridge package 46 in such an attitude that in terms of the direction Y, the cleaning unit 8, developing device 9, and hinge 49 are positioned in the listed order. As described above, however, in terms of the direction Z in the drawings, the handhold 45 of the process cartridge P is on the lid 48 side of the flanges 47*a* and 48*a*, across which the frame 47 and lid 48 are joined. Therefore, as the cartridge package 46 is opened, the handhold 45 will be on the top side of the flanges 47*a* and 48*a*. Therefore, there is a merit that as the cartridge package 46 is opened, the handhold 45 can be easily spotted by a user.

<Removal of Cartridge from Cartridge Package>

Figure 12:
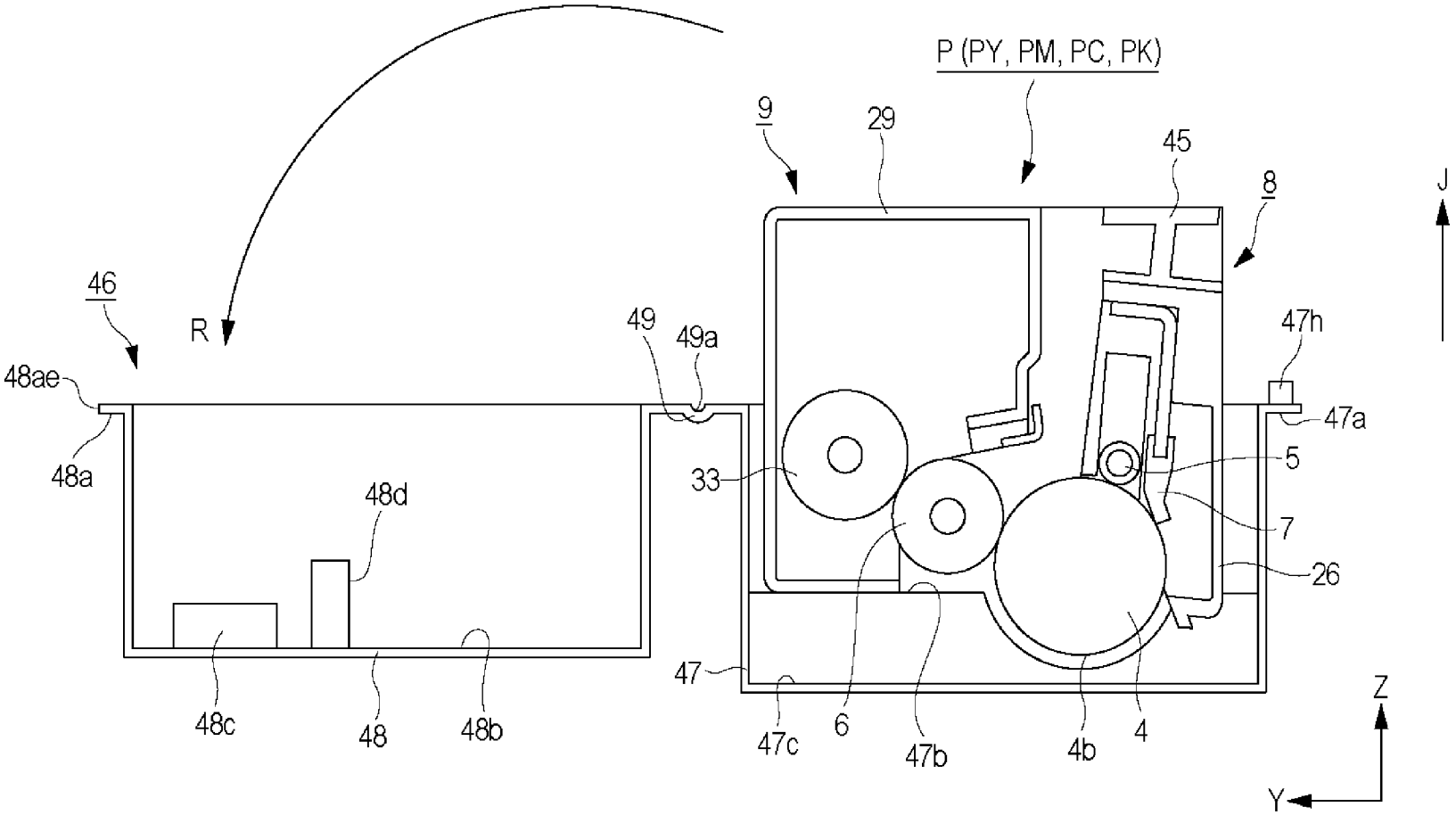
FIG. 12 is a schematic sectional view of a combination of the cartridge package and cartridge in the first embodiment, which is in the state in which the lid of the package is fully open.

Next, referring to FIGS. 10 and 12, the operation for removing the cartridge P from the cartridge package 46 is described. FIG. 12 is a schematic sectional view of the cartridge P and cartridge package 46, when they are in the state in which the cartridge P can be simply moved out of the cartridge package 46. The operation to take the cartridge P out of the cartridge package 46 is to be carried out in the order of opening of the lid 48, grasping of the handhold 45, removal of the cartridge P from the cartridge package 46, and installation of the cartridge P into the apparatus main assembly 2.

Referring to FIG. 10, a user is to virtually separate the lid 48 from the frame 47 through the cartridge package opening operation, which will be described later. Then, the user is to rotationally move the lid 48 in the direction indicated by an arrow mark R in FIG. 12, about the pivot line 49*a* of the hinge 49. As the lid 48 is rotationally moved roughly 180 degrees, it becomes possible for the cartridge P to be moved out of the cartridge package 46 (FIG. 12). Incidentally, as long as the cartridge P can be moved out of the cartridge package 46, the lid 48 does not need to be rotationally moved as much as 180 degrees. When unsealing (opening) the cartridge package 46, positioning the cartridge package 46 so that the unsealing portion 18J (FIG. 10) will be on the user side makes it easier for the user to carry out the operation to open the cartridge package 46 than positioning the cartridge package 46 so that the hinge 49 will be on the user side. Thus, in the following description of the operation to open (unseal) the cartridge package 46, it is assumed that the user opens the cartridge package 46, with the cartridge package 46 positioned so that the unsealing portion 48J of the cartridge package 46 is on the user side.

Next, the user is to grasp the handhold 45 while the cartridge package 46 is in the state shown in FIG. 12. It is to be after the user rotationally moves the lid 48 that the user is to grasp the handhold 45. During this step, the handhold 45 is on the unsealing portion 48J side of the cartridge package 46 as described above. Therefore, as the user open the lid 48, it is easy for the user to recognize the handhold 45. Thus, the user can smoothly grasp the handhold 45, without being interfered by the lid 48.

Next, the operation to install the cartridge P into the apparatus main assembly 2 after the removal of the cartridge P from the cartridge package 46 is described. In this operation, the cartridge P is moved out of the cartridge package 46 in the direction indicated by an arrow mark J in FIG. 12, and is installed into the apparatus main assembly 2. When the user is installing the cartridge P into the apparatus main assembly 2, the user is to position himself or herself on the downstream side of the apparatus main assembly 2 in terms of the direction indicated by an arrow mark G1 in FIG. 5, in which the cartridge tray 43 is to be pulled out of the apparatus main assembly 2. The attitude in which the cartridge P is placed when it is installed into the apparatus main assembly 2 is such that in terms of the direction G1 in which the cartridge tray 43 is to be pulled out of the apparatus main assembly 2, the cleaning unit 8 is on the downstream side of the developing device 9. It is also such an attitude that, in terms of the direction H1 in which the cartridge P is installed into the apparatus main assembly 2, the photosensitive drum 4 is on the downstream side of the cleaning unit 8 and the handhold 45 is on the upstream side of the cleaning unit 8. It is the same attitude as the attitude in which the user grasps the handhold 45 of the cartridge P when the cartridge P is in the cartridge package 46. That is, the user can install the cartridge P into the apparatus main assembly 2 while keeping the cartridge P in the same attitude as the attitude in which the cartridge P was moved out of the cartridge package 46. Thus, while moving the cartridge P out of the cartridge package 46 and installing the cartridge P into the apparatus main assembly 2, the user does not need to carry out annoying operations such as grasping the cartridge P differently from how the cartridge P was held when it was removed from the cartridge package 46, turning the wrist, and/or the like operation. That is, this embodiment improves the cartridge package 46 in usability.

As described above, this embodiment relates to the cartridge package 46 for packaging the cartridge P, which is removably installable in the image forming apparatus 1, and has the photosensitive drum 4 and/or at least one among the processing means for processing the photosensitive drum 4. The cartridge package 46 is such a packaging container that is made up of the frame 47 having the first recessed portion 47*c*, and the lid 48 having the second recessed portion 48*b*. Further, the packaging container 46 has the pivot line 49*a* about which the frame 47, or the container portion, and lid 48 are rotationally movable relative to each other. It is structured so that as the first and second recessed portions 47*c* and 48*c* are joined, the storage space 46*b* for storing the cartridge P is formed.

<Detail of Tear Strip>

Figure 15:
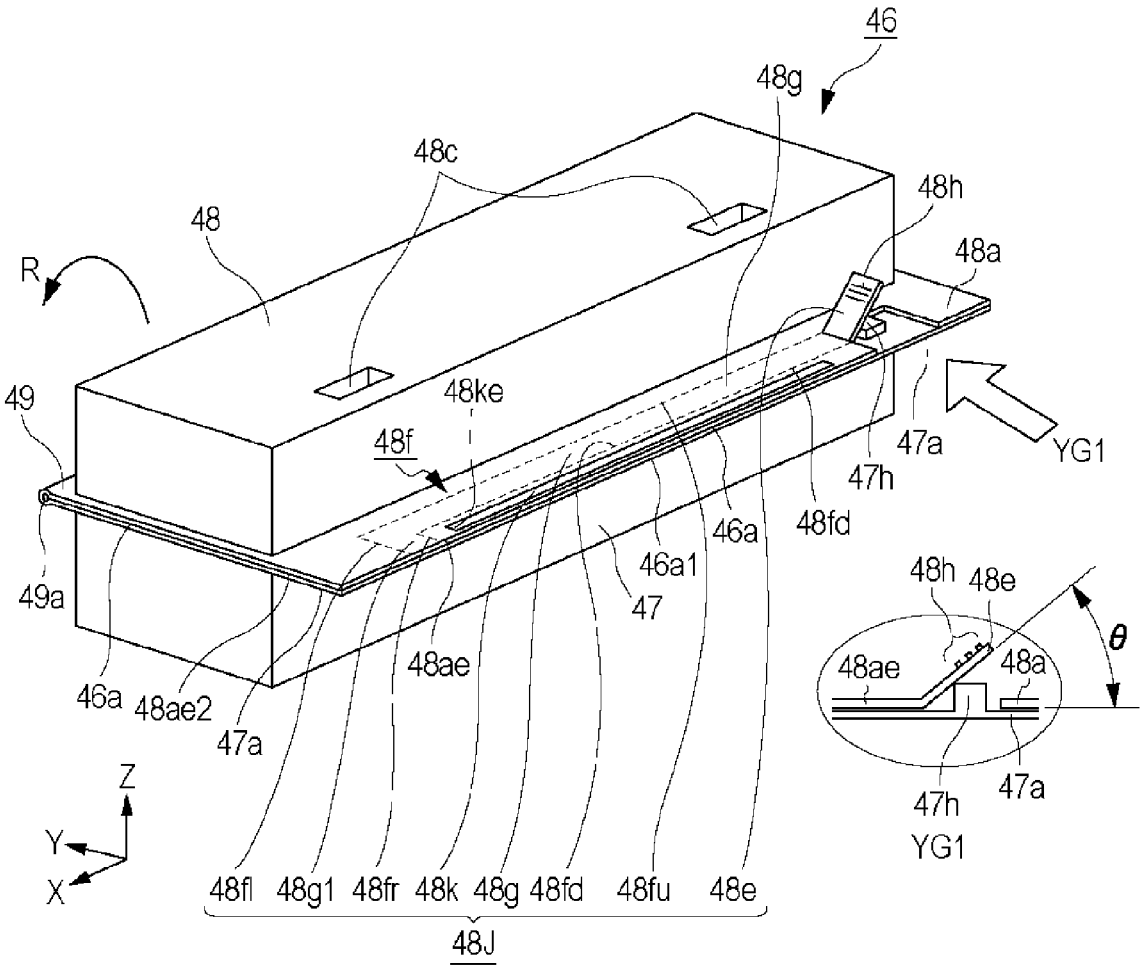
FIG. 15 is a schematic perspective view of the combination of the cartridge package and cartridge therein, which is in the state in which the cartridge is remaining enclosed in the package.
Figure 16:
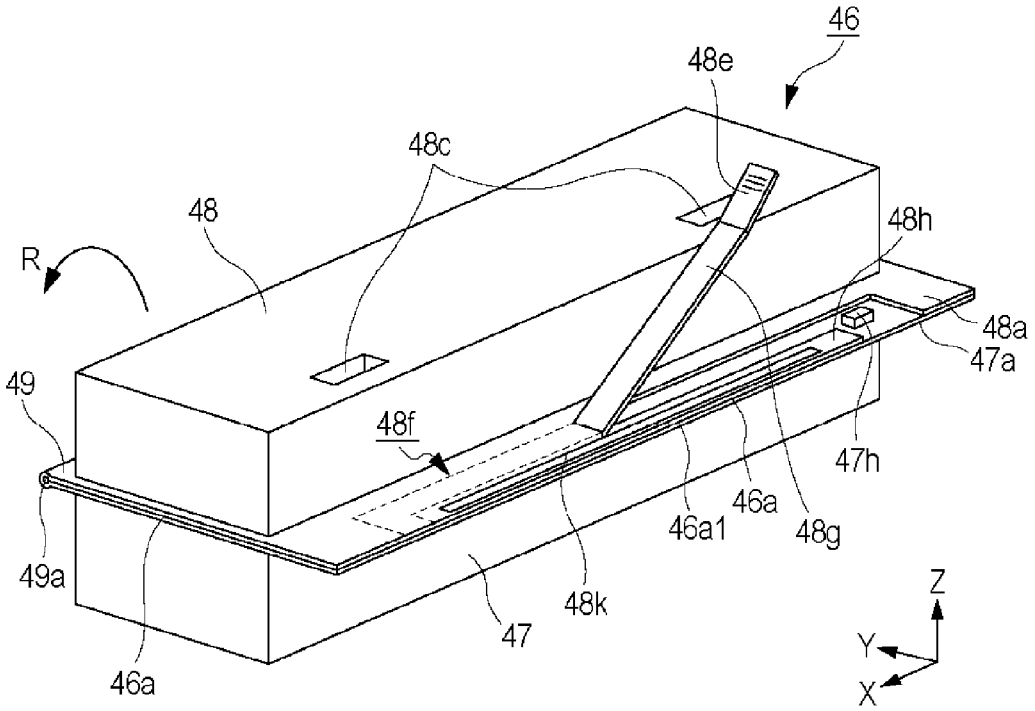
FIG. 16 is a schematic perspective view of the combination of the cartridge package and cartridge therein, which is in the state in which the tear-strip (separable portion) of the package is being removed (separated).

Next, referring to FIG. 15, the structure of the unsealing portion 48J is described. The unsealing portion 48J has two lines of perforation for allowing the tear strips 48*g* and 48*g*1 of the unsealing portion 48J to be torn away from the unsealing portion 48J. That is, the two lines of perforation are a line of perforation made up of lines 48*f* and 48*f*1, and a line of perforation made up of lines 48*fd* and 48*fr* of perforation.

Further, the unsealing portion 48J is a part of the flange 48*a* by which the lid 48 is joined with the flange 47 or the bottom portion of the cartridge package 46. The area between the lines 48*fu* and 48*fr* of perforation and the area between the lines 48*f*1 and 48*fr* of perforation can be torn away as tear strips, can be torn away as tear strips 48*g* and 48*g*1, respectively, from the cartridge package 46 (lid 48), with the use of a method which will be described later.

Further, one (drive-side) of the lengthwise ends of the tear strip 48*g* is provided with a pull-tab 48*e*, which is a portion to be gripped by a user when the user separates the tear strips 48*g* and 48*g*1 from the cartridge package 46, with the use of a method which also will be described later. The pull-tab 48*e* will be described later in detail.

At the other lengthwise end (non-drive-side) of the line 48*fu* of perforation, the line 48*f*1 of perforation extends to the end surface 48*ae* of the flange 48*a*, in the direction perpendicular to the line 48*fu* of perforation. Further, at the end of the line 48*fd* of perforation, the line 48*fr* of perforation extends to the end surface 48*ae* of the flange 48*a*, in the direction perpendicular to the line 48*fd* of perforation. Further, the tear strip 48*g*1 surrounded by the line 48*f*1 and line 48*fr* of perforation extends, at the other lengthwise end of the tear strip 48*g*, in the direction perpendicular to the tear strip 48*g*, as far as the end surface 48*ae* of the flange 48*a*.

As described above, the tear strips 48*g* and 48*g*1 are positioned in a manner to surround the joint (bonded portion) 48*k*. That is, in terms of the direction (Y) perpendicular to the lengthwise direction of the hinge 49, the tear strip 48*g* is between the first recessed portion 47*c* and joint 48*k*, and the tear strips 48*g* and 48*g*1 are located close to the joint 48*k*. Therefore, it is unlikely for the flange 48*a* to be unintentionally separated from the flange 47*a* when the tear strips 48*g* and 48*g*1 are torn away. Therefore, it is easier to tear away the tear strips 48*a* and 48*g*1. It is only the lid 48 that is provided with the lines 48*fu*, 48*fd*, 48*f*1 and 48*fr*, and tear strips 48*g* and 48*g*1. In this embodiment, the lines 48*fu*, 48*fd*, 48*f*1 and 48*fr* of perforation are between the joint 48*k* and second recessed portion 48*b* of the lid 48 (FIG. 11). However, it is not mandatory that the unsealing portion 48J is a part of the flange 48*a*.

Figure 17:
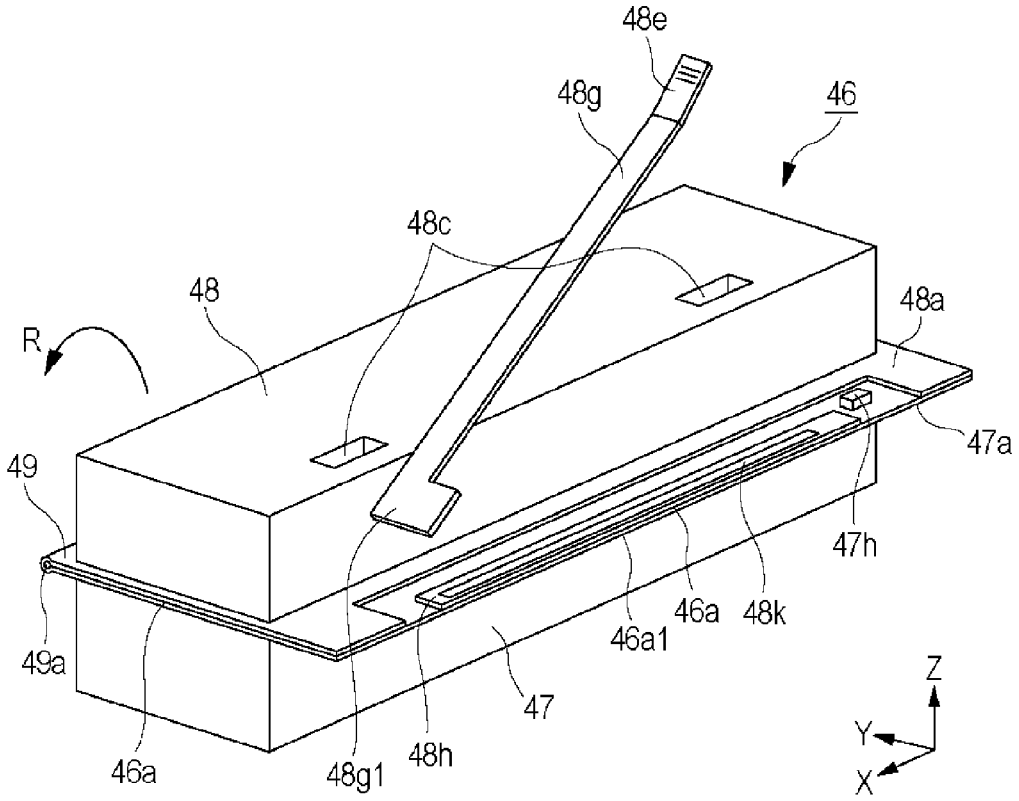
FIG. 17 is a schematic perspective view of the combination of the cartridge package and the cartridge therein, in the first embodiment, after the removal of the tear-strip (separable portion) of the package.
Figure 19:
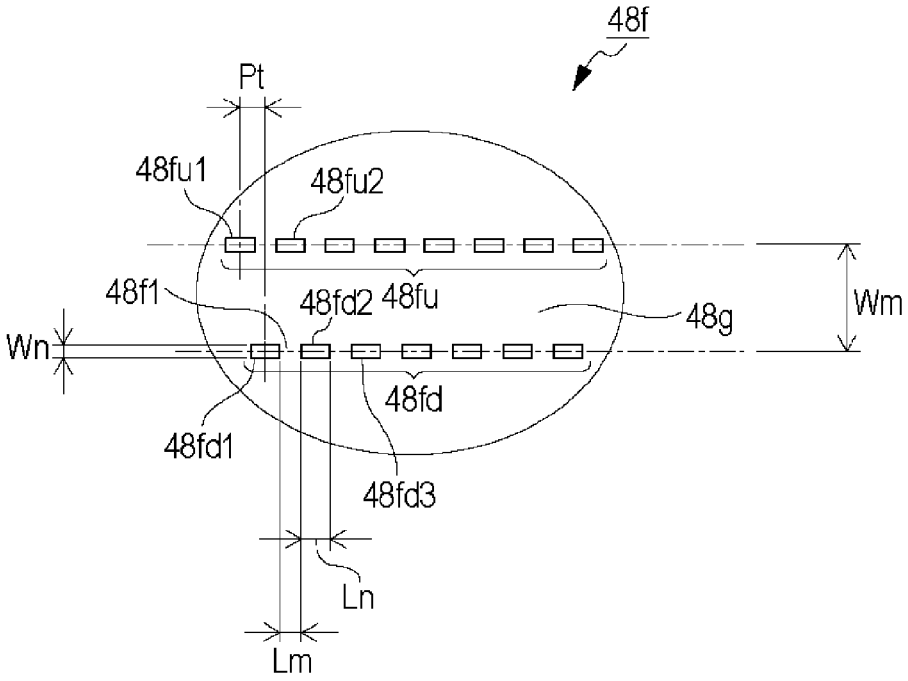
FIG. 19 is an enlarged view of the perforated portion of the cartridge package in the first embodiment.

Referring to FIG. 19 which is an enlarged view of the lines 48*fu* and 48*fd* of perforation shown in FIG. 15, the details of the line 48*fd* of perforation are described. The lines 48*fu*, 48*f*1 and 48*fr* of perforation are similar to the lines 48*fd* of perforation. Therefor, they are not described. The line 48*fd* of perforation is made up of multiple perforations 48*fd*1 and 48*fd*2, and so on, which are aligned with roughly equal intervals as shown in FIG. 19, in which Ln and Wn stands for the length and width of each perforation 48*fdl* of the line 4*fdr* of perforation, and Lm and Wm stands for the distance between adjacent two perforations 48*fd*1 and 48*fd*2 and the distance between the line connecting the center of the perforation 48*fd*1 and the center of the perforation 48*fd*2, and the line connecting the center of the perforation 48*fu*1 and the center of the perforation 48*fu*2, respectively. Values for Ln, Wn, Lm and Wm have only to be in a range of 0.1-20 mm, 0-2 mm, 0.3-2 mm, and 3-10 mm, respective, in consideration of the amount of force necessary for a user to tear the tear strips 48*g* and 48*g*1 away from the lid 48, and also, in order to prevent the unsealing portion 48J from being torn at the lines 48*fu*, 48*fd*, 48*fr* and/or 48*f*1 of perforation, by the impacts or the like which occur while a packaged cartridge P is transported. In this embodiment, Ln, Wn, Lm and Wm were 10 mm, 0.1-1 mm, 0.7 mm, and 3-5 mm, respectively. The amount of force necessary to separate (tear) the tear strip 48*g* and 48*g*1 from the lid 48 was roughly 5 (N). Referring to FIG. 17, in this embodiment, the two lines 48*fu* and 48*fd* of perforation, which are in parallel to each other, are positioned so that the perforation 48*fd*1 and 48*fd*2 are offset from each other by Pt (0.1-10 mm) in terms of the lengthwise direction of the tear strip 48J. This arrangement is for dispersing the amount of force necessary to destroy the portion 48*f*1 between the perforations 48*fd*1 and 48*fd*2. It is effective to reduce the amount of force required of a user to separate the tear strips 48*g* and 48*g*1 from the lid 48.

<Detail of Shape of Pull-Tab>

Next, the details of the pull-tab 48*e* which is a tab to be held by a user will be described.

Figure 23:
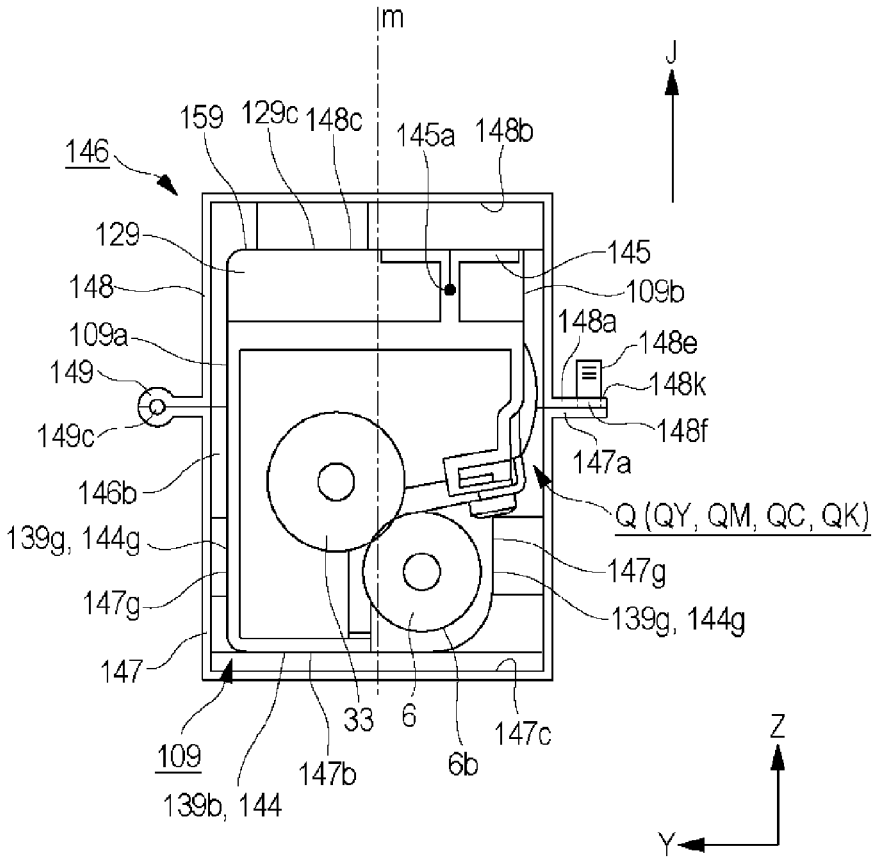
FIG. 23 is a schematic sectional view of the cartridge package in the third embodiment of the present invention.

Referring to FIG. 10, one of the lengthwise ends of the tear strip 48*g* is provided with the pull-tab 48*e*, which is an integral part of the tear strip 48*g*. Referring to FIG. 15, in this embodiment, only one of the lengthwise ends of the tear strip 48*g* is provided with the pull-tab 48*e*. However, both lengthwise ends of the tear strip 48*g* may be provided with the pull-tab 48*e*. Slip prevention strips 48*h* are roughly perpendicular to the direction (lengthwise direction) in which the tear strip 48*g* is to be separated from the flange 48*a*. The pull-tab 48*e* is slightly bent (angled) relative to the flange 48*a* (opposite direction from exposed portion 4*d* of photosensitive drum 4; direction Z in drawings) (FIGS. 15 and 23).

Bending the pull-tab 48*e* makes it easier for a user to hold the pull-tab 48*e*. Further, it makes it easier for the user to spot the pull-tab 48*e*, and also, for the user to recognize the direction in which the pull-tab 48*e* is to be pulled. In addition, the pull-tab 48*e* may be given a color different from those of the portions adjacent to the pull-tab 48*e*, in order to make the pull-tab more visible. The angle θ of the pull-tab 48*e* relative to the flange 48*a* is desired to be in a range of 5°-90°.

Next, the method for separating the pull-tab 48*e* from the flange 48*a* and bending the pull-tab 48*e* relative to the flange 48*a* is described.

Referring to FIG. 15, the portion of the frame 47, which corresponds in position to the pull-tab 48*e*, with which the lid 48 is provided, is provided with a protrusion 48*h* which protrudes toward the lid 48. Thus, as the flange 47*a* and flange 48*a* are joined to each other, the pull-tab 48*e* is pushed by the protrusion 47*h*, being thereby torn from the flange 48*a* in such a manner that it is angled relative to the flange 48*a*. Thus, it is unnecessary to provide the process for packaging the cartridge P, with an additional step, that is, a step for lifting the pull-tab 48*e*. In other words, this arrangement can reduce in cost the process for packaging the cartridge P. Obviously, the pull-tab 48*e* may be slightly lifted from the flange 48*a* through an additional step so that it remains angled relative to the flange 48*a*.

<Details of Joint>

Next, referring to FIG. 15, the joint 48*k* is described.

The joint 48*k* is where the lid 48 and frame 47 are joined to prevent microscopic foreign substances such as dust from entering the cartridge package 46, and then, into the process cartridge P. As for the method for joining (bonding) the lid 48 and frame 47 across the joint 48*k*, thermal welding, supersonic welding, or the like may be used. Further, the lid 48 and frame 47 may be joined with the use of adhesive, two-sided adhesive tape, staples, or the like.

In this embodiment, supersonic welding is used. The lid 48 and frame 47 may be joined across the entire area (joint 48*k*) surrounded by a rectangle in FIG. 15, or may be spot-welded to each other at multiple points (unshown) within the above-mentioned area.

<Detailed Description of Operation to Open Cartridge Package>

Next, referring to FIGS. 15-18, the operation to open the cartridge package 46 is described in detail.

Figure 18:
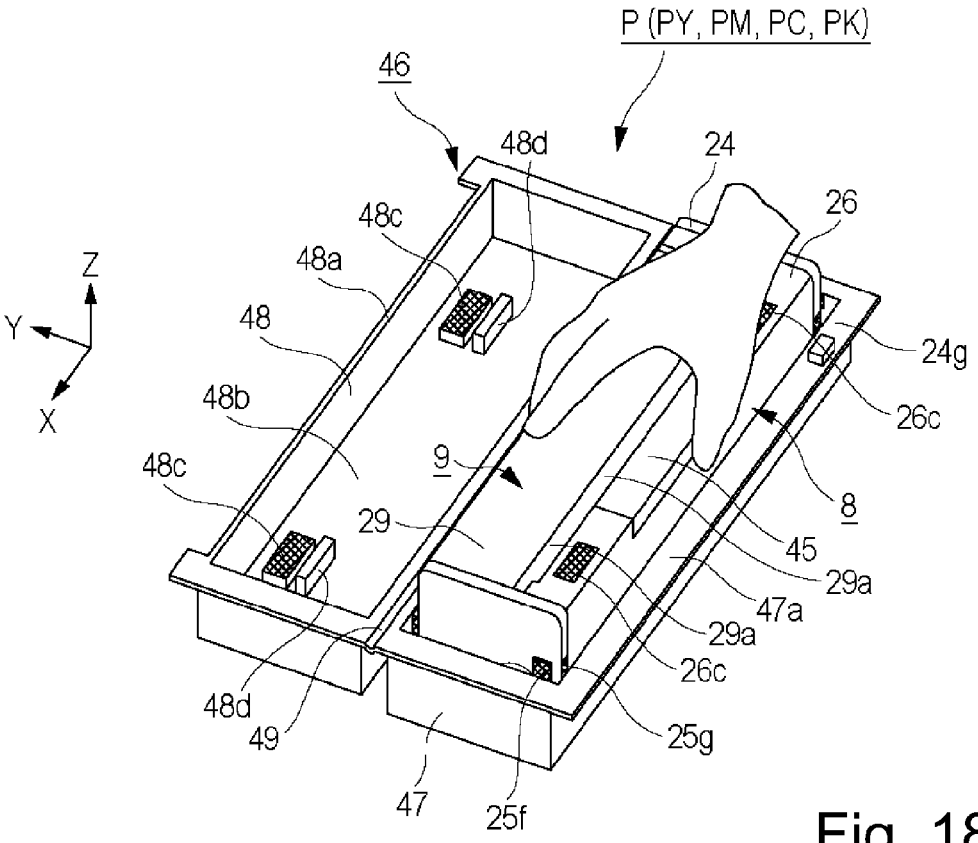
FIG. 18 is a schematic perspective view of the combination of the cartridge package, and the cartridge therein, in the first embodiment, and the user's (operator's) hand, when the cartridge is being removed from the cartridge package.

To begin with, a user (operator) is to hold the pull-tab 48*e* which is in the state shown in FIG. 15. Then, the user is to pull the pull-tab 48*e* in a manner to pull the pull-tab 48*e* away from the flange surface 48*a* at which the above described first and second recessed portions 47*c* and 48*c* oppose to each other, toward the second recessed portion 48*b* (FIG. 11) (toward lid; direction Z in drawing), to separate the tear strip 48*g* from the cartridge package 46. During this operation, the only direction in which the pull-tab 48*e* can be pulled is the direction Z in the drawing. Therefore, the user is to position the cartridge package 46 in such an attitude that the handhold 45 of the process cartridge P faces upward (attitude shown in FIG. 11). Then, the user is to separate the tear strips 48*g* and 48*g*1 from the cartridge package 46 as shown in FIG. 17. Then, the user is to open the lid 48 as shown in FIG. 18, as described above. With the lid 48 being open, the handhold 45 can be easily spotted by the user. Thus, the user is to grasp the handhold 45 and take the cartridge P out of the cartridge package 46.

Referring to FIG. 15, the line 48*fu* of perforation is perpendicular to the line 48*fd* of perforation, and is extended as far as the end surface 48*ae* of the flange 48 (so are line 48*fd* of perforation and line 48*fr* of perforation). However, this embodiment is not intended to limit the present invention in scope in terms of the positioning of these lines of perforation. For example, the present invention is also applicable to a cartridge package 46 structured so that the line 48*fr* of perforation extends straight to the end surface 48*ae*2 of the flange surface 48*a* (so may be line 48*fd* of perforation).

As described above, in this embodiment, the cartridge package 46 is structured so that the tear strips 48*g* and 48*g*1 with which the lid 48 is provided can be pulled toward the lid 48 (second recessed portion 48*b*) to be separated from the flange surface 48*a*.

Figure 13:
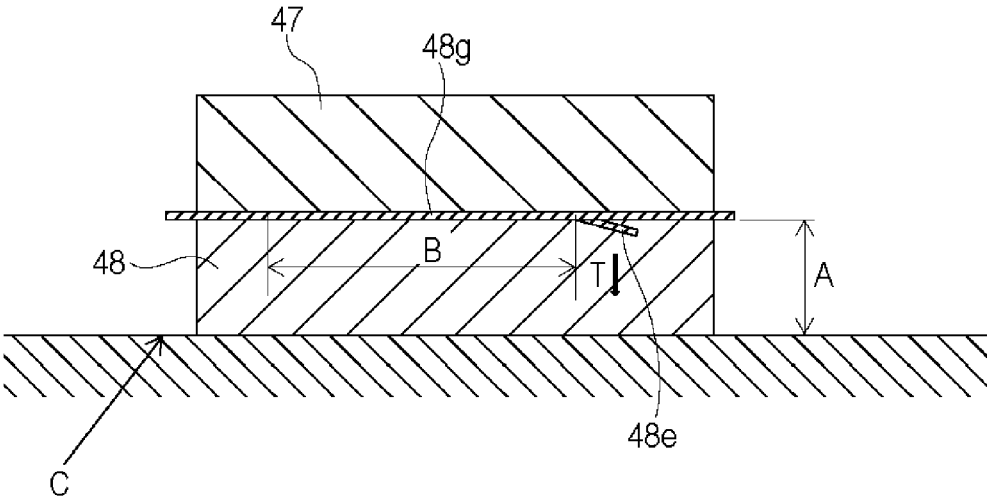
FIG. 13 is a schematic sectional view of an example of a comparative cartridge package.
Figure 13:
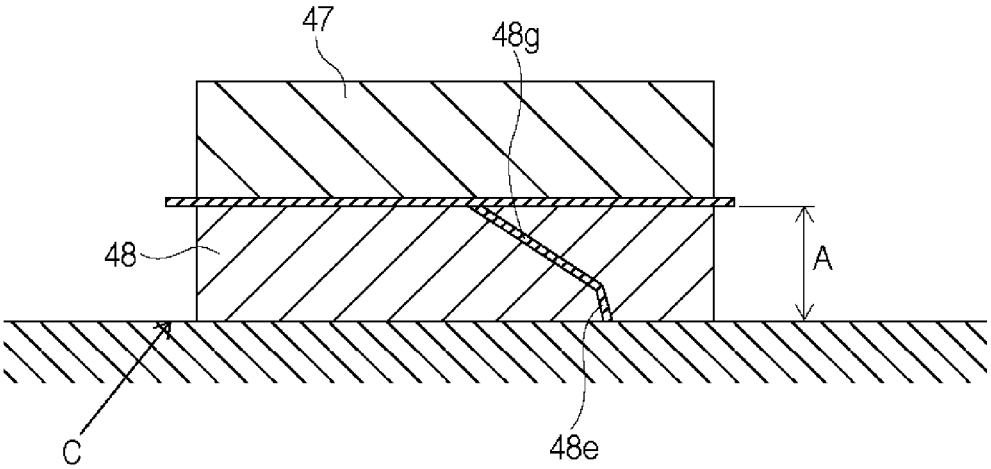
Figure 14:
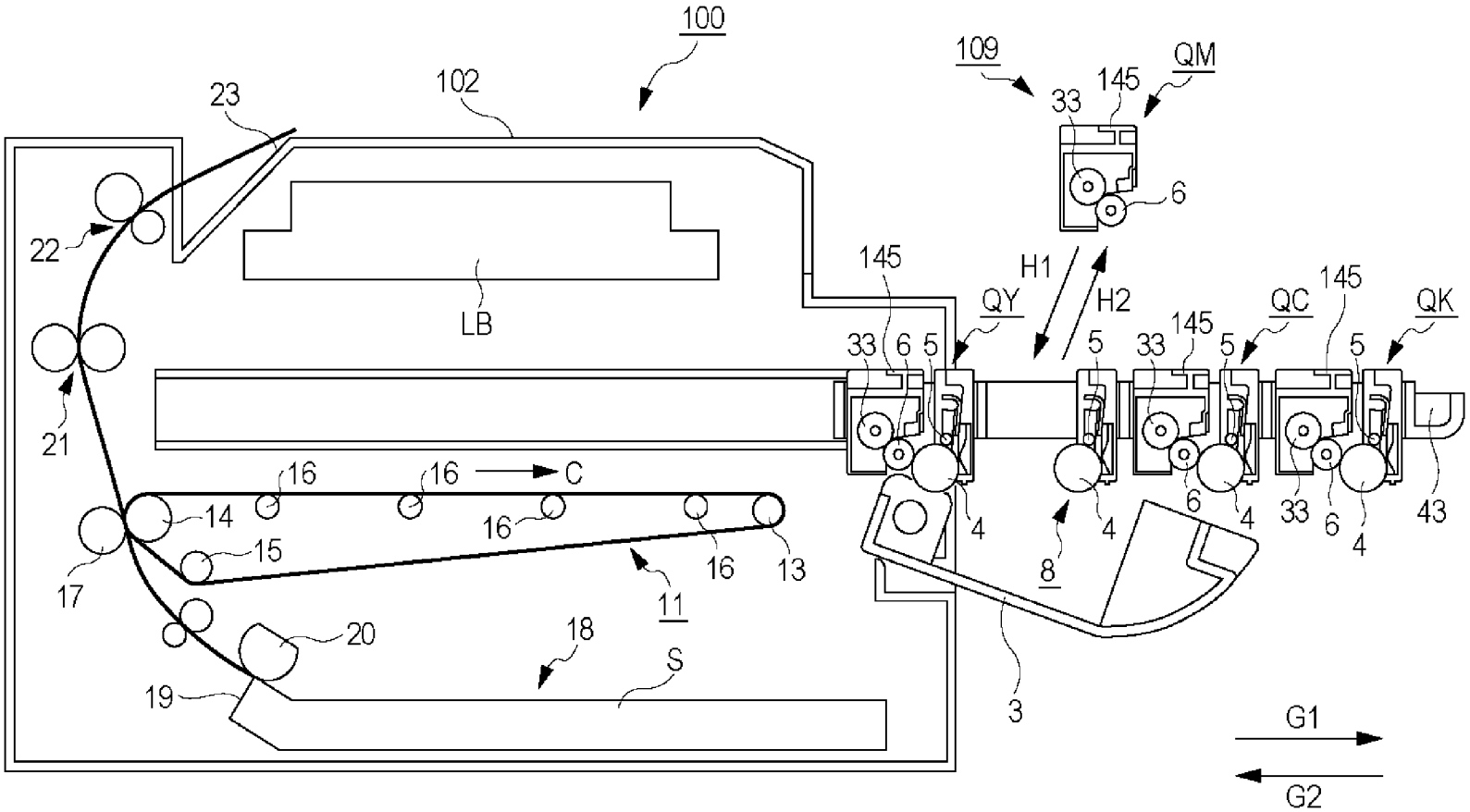
FIG. 14 is a schematic sectional view of the image forming apparatus in the first embodiment, which is in the state in which the developing devices of the apparatus can be placed into, or removed from, the cartridge tray of the apparatus.

Further, when the cartridge P is placed in the cartridge package 46 and the lid 48 is closed, the exposed portion 4*b* of the photosensitive drum 4 is positioned on the first recessed portion 47*c* side relative to the joint between the recessed portion 47*a* of the frame 47 and the recessed portion 48*b* of the lid 48. Further, the handhold 45 is placed on the second recessed portion 48*b* side relative to the flange surface 48*a*. Since the pull-tab 48*e* is angled relative to the flange surface 48*a*, it can be easily spotted. Referring to FIG. 13, there is the following relationship between the length B (FIG. 10) and the height A of the lid 48: A<B. Referring to FIG. 13(*a*), in a case where it is attempted to position the cartridge package 46 so that the lid 48 is placed under the frame 47, and separate the tear strip 48*g* downward, that is, in the direction indicated by an arrow mark T, the surface C on which the cartridge package 46 is placed interferes with the movement of the pull-tab 48*e* (FIG. 13(*b*)), making it impossible for the pull-tab 48*e* to be completely separated from the flange surface 48*a*. Therefore, the cartridge package 46 is to be positioned so that the lid 48 will be on the opposite side of the cartridge package 46 from the surface C, in order to allow the tear strip 48*g* to be completely separated from the cartridge package 46. That is, the cartridge package 46 is limited in terms of the direction in which its tear strip 48*g* can be separated from the flange surface 48*a*. Therefore, the user is obliged to properly position the cartridge package 46. Further, as the lid 48 is opened, the handhold 45 of the process cartridge is easily spotted, ensuring that the user holds the cartridge P only by the handhold 45. That is, only the handhold 45 that the user grasps to take the cartridge P out of the cartridge package 46. Therefore, it does not occur that the user unintentionally touches the exposed portion 4*c* of the photosensitive drum 4. Therefore, the cartridge P can be smoothly installed into the apparatus main assembly 2.

Embodiment 2

Figure 20:
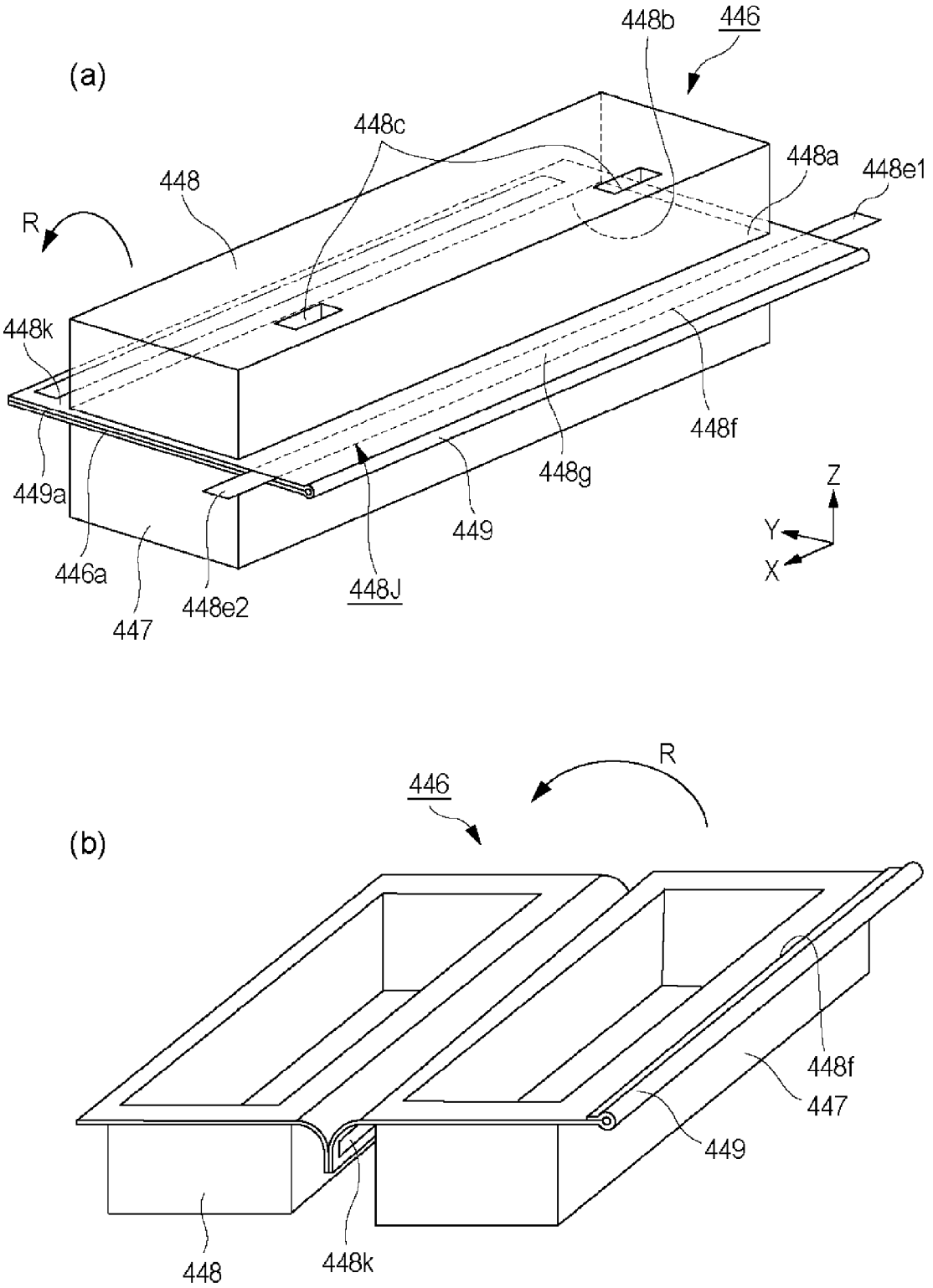
FIG. 20 is a schematic perspective view of the cartridge package in the second embodiment.

Next, referring to FIG. 20, another embodiment of the present invention is described as the second embodiment of the present invention. The components, sections, processing means, etc., of the image forming apparatus in this embodiment, which are the same in description as the counterparts in the first embodiment, are not described.

Referring to FIG. 20(*a*), the cartridge package 446 is provided with a pair of pull-tab 448*e*1 and 448*e*2 which extend outward of the cartridge package 346 from the lengthwise ends of the flange 448*a* of the cartridge package 446 in the lengthwise direction (indicated by arrow mark X in drawing) of the cartridge package 446. Since the pull-tab 448*e*1 and 448*e*2 in this embodiment extend beyond the lengthwise ends of the flange 448*a*, this embodiment is superior to the first embodiment in terms of pull-tab visibility. Further, the lid 448 is provided with an unsealing portion 448J as the lid 45 in the first embodiment is provided with the unsealing portion 48J. In terms of the direction Y, the joint 448*k* is on the opposite side of the lid 448 from the hinge 449. In terms of the direction Y, the unsealing portion 448J is on the same side of the lid 448 as the hinge 449. That is, in terms of the direction Y, the hinge 449, unsealing portion 448J, second recessed portion 448*b*, and joint 448*k* are positioned in the listed order. After the separation of the tear strip 448*g* from the lid 448 by the user, the user is to rotationally move the lid 448 in the direction indicated by an arrow mark R, about the pivot line 449*a* to open the lid 448 (FIG. 20(*b*)). Consequently, it becomes possible for the cartridge P to be taken out of the cartridge package 346. Even if the unsealing portion 448J is on the hinge side, that is, it is placed between the first recessed portion 447*c* and joint 448*k* in terms of the direction (Y) perpendicular to the lengthwise direction of the hinge 449, the same effects as those obtainable by the first embodiment can be obtained by the second embodiment.

Figure 21:
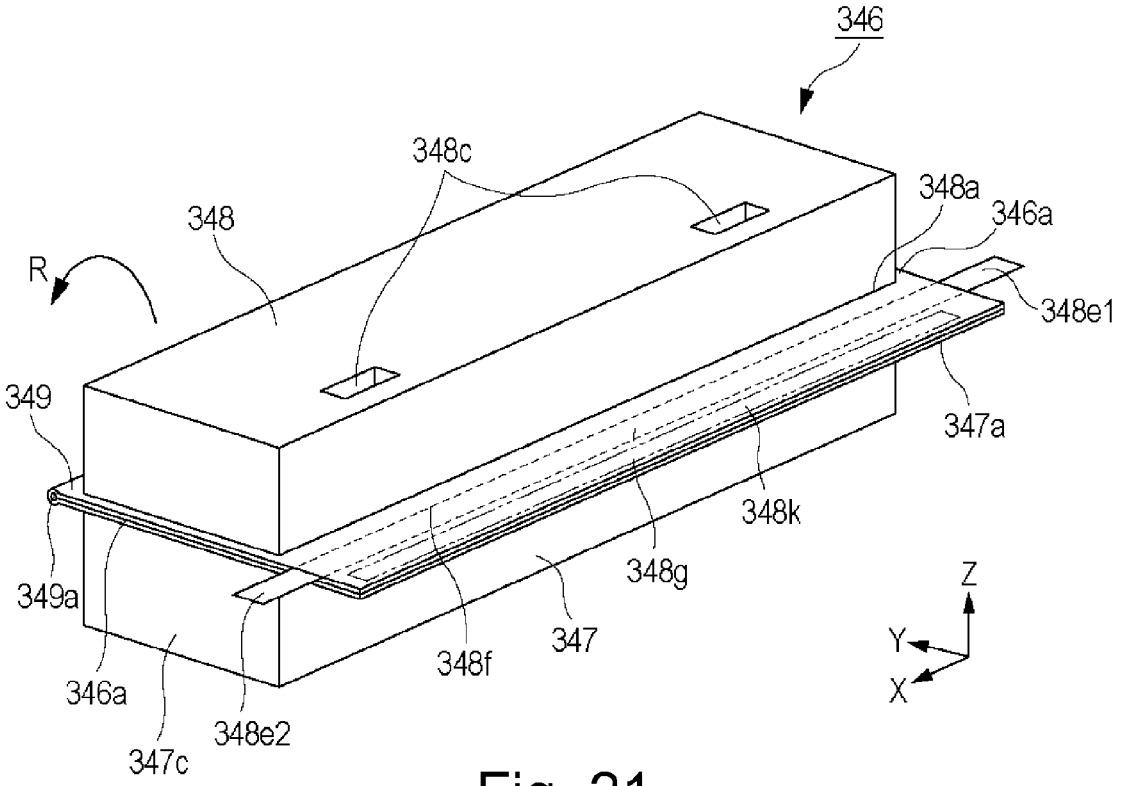
FIG. 21 is a schematic perspective view of the cartridge package in the second embodiment.

One of the modifications of the second embodiment is shown in FIG. 21. In this modification, the cartridge package 446 has a pair of pull-tabs 348*e*1 and 343*e*2 which protrude in the lengthwise direction (indicated by X in drawing) of the cartridge package 346. The lid 348 is between the above described tear strip 348*g* and the hinge 349 having the pivot line about which the lid 348 rotates when the lid 348 is opened. Further, the tear strip 348*g* is between the joint 348*k* and the lid 348. The user is to separate the tear strip 348*g* from the lid 348 and rotate the lid 348 in the direction indicated by an arrow mark R about the pivot line 249*a* of the hinge 349. As the lid 348 is rotated, it becomes possible for the cartridge P to be moved out of the cartridge package 346.

Figure 22:
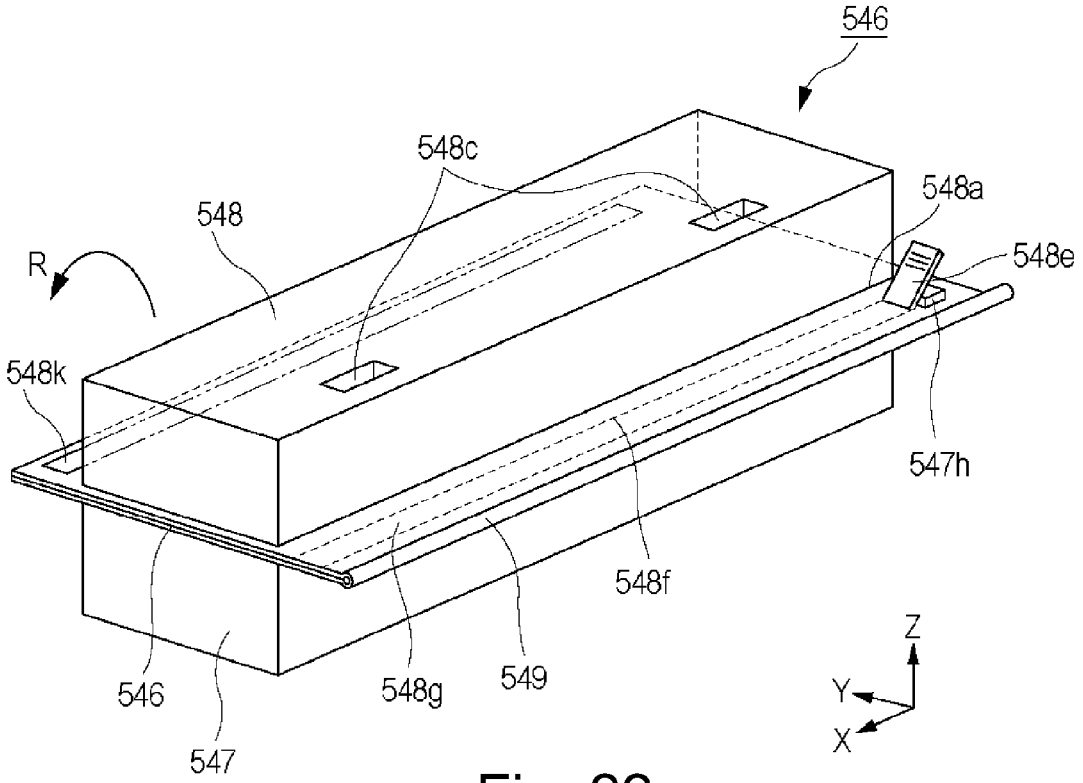
FIG. 22 is a schematic perspective view of the cartridge package in the second embodiment.

Shown in FIG. 22 is another modification of the second embodiment. In this modification, one of the lengthwise ends of the cartridge package 546 has a pull-tab 548*e* which is upwardly angled relative to the flange surface 548*a*. The lid 548 is between the tear strip 548*g* and the line of connection between the frame 547 and lid 548, that is, the pivot line about which the lid 548 is rotated when it is opened. Further, the tear strip 548*g* is between the hinge 549 and lid 548. As the user separates the tear strip 548*g* from the lid 548, and rotates the lid 548 about the pivot line 548*k* of the connection between the frame 547 and lid 458, in the direction indicated by an arrow mark R, it becomes possible for the cartridge P to be moved out of the cartridge package 546.

Embodiment 3

Figure 24:
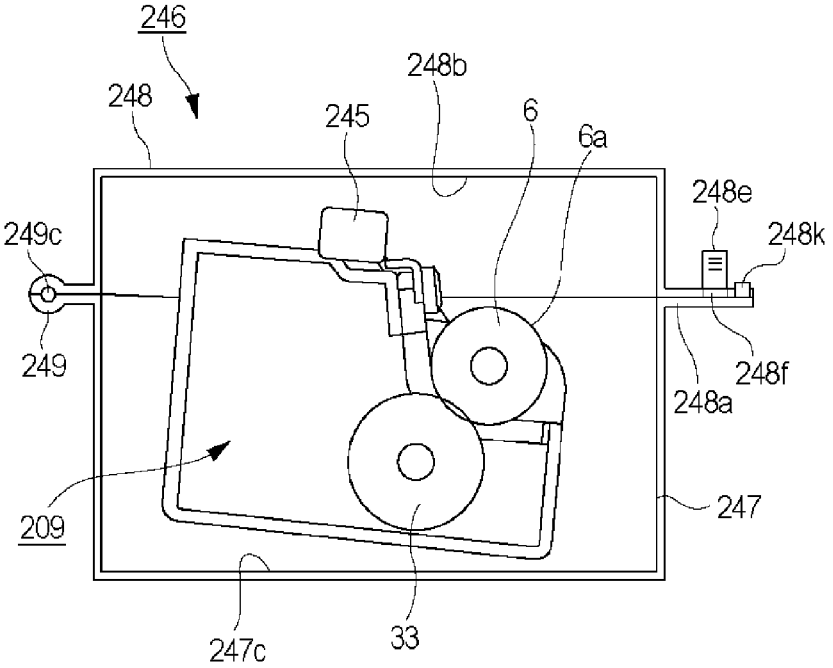
FIG. 24 is a schematic sectional view of the cartridge package in the third embodiment.

Next, referring to FIGS. 23 and 24, another embodiment of the present invention is described as the third embodiment of the present invention.

Referring to FIG. 23, the process cartridge Q in this embodiment has only the developing device 209. The components, sections thereof, etc., of the cartridge Q, which are the same in description as the counterparts in the first embodiment are not described.

After the enclosure of a process cartridge such as the cartridge 209 shown in FIG. 24 in the cartridge package 246, the exposed portion 6*a* of the development roller 6 is on the recessed portion 247*a* side relative to the flange surface 248*a* where the first recessed portion 247*a* of the frame 247 and the second recessed portion 248*b* of the lid 248 are joined. Also in this case, designing the cartridge P and the cartridge package 246 so that when the cartridge P is properly placed in the cartridge package 246, the handhold 245 of the cartridge P is placed on the lid 248 side of the flange surface 248*a*, makes it easier for the handhold 245 to be spotted. In other words, the structural arrangement, in this embodiment, for the process cartridge Q, can provide the same effects as those obtainable by the first and second embodiments.

Effects of Present Invention

As described above, the combination of a process cartridge and cartridge package therefor, which is in accordance with the present invention, is simpler in structure than any combination of a process cartridge and cartridge package therefor, which is in accordance with the prior art, and yet, can protect the cartridge from the vibrations and/impacts which occur during the transportation of the cartridge, just as well as, or even better than, any combination of a process cartridge and cartridge package therefor, which is in accordance with the prior art.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 120998/2013 filed Jun. 7, 2013 which is hereby incorporated by reference.

What is claimed is:

1. A packing member for packing a cartridge for an image forming apparatus, said packing member comprising:

a frame portion having a recess for accommodating said cartridge;

a closing member portion for openably closing said recess;

a hinge portion for movably connecting said closing member portion relative to said frame portion to open and close said recess; and a connecting portion connecting said frame portion and said closing member portion to close said recess, wherein said closing member portion is provided with a separating portion removable from said closing member portion while leaving said connecting portion on said frame portion.

2. A packing member according to claim 1, wherein said separating portion includes a grip portion for being gripped when said separating portion is removed from said closing member portion.

3. A packing member according to claim 2, wherein said grip portion projects from said closing member portion in a direction opposite a recessing direction of said recess.

4. A packing member according to claim 3, wherein said grip portion is projected by a protrusion provided on said frame portion.

5. A packing member according to claim 1, wherein said frame portion is provided with a flat flange around said recess, and said connecting portion connects said closing member portion and said flat flange.

6. A packing member according to claim 1, wherein said separating portion is provided between said recess and said connecting portion in a direction perpendicular to a longitudinal direction of said hinge portion.

7. A packing member according to claim 1, wherein said separating portion is provided between said recess and said hinge portion in a direction perpendicular to a longitudinal direction of said hinge portion.

8. A packing member according to claim 1, wherein said cartridge includes a grip portion that is exposed by opening said closing member portion.

9. A packing member according to claim 1, wherein said separating portion is between two cut away portions provided in said closing member portion to facilitate the removal of said closing member portion.

10. A packing member according to claim 1, wherein said recess is a first recess, and said closing member portion is provided with a second recess for cooperating with said first recess to provide a space for accommodating said cartridge.

11. A packing member according to claim 1, wherein said cartridge includes a photosensitive member and process means actable on said photosensitive member.

12. A packing member according to claim 1, wherein said cartridge includes a developing device for developing an electrostatic latent image on a photosensitive member.

13. A packing member according to claim 1, wherein said packing member is provided by vacuum pressure molding of thin recording material.

14. A cartridge detachably mountable to an image forming apparatus, said cartridge being packed in a packing member, said packing member including:

a frame portion having a recess for accommodating said cartridge;

a closing member portion for openably closing said recess;

a hinge portion for movably connecting said closing member portion relative to said frame portion to open and close said recess; and a connecting portion connecting said frame portion and said closing member portion to close said recess, wherein said closing member portion is provided with a separating portion removable from said closing member portion while leaving said connecting portion on said frame portion, wherein said cartridge is enabled to be taken out of said packing member by removing said separating portion from said packing member and opening said closing member portion relative to said frame portion while leaving said connecting portion on said frame portion.

15. A cartridge according to claim 14, wherein said separating portion includes a grip portion for being gripped when said separating portion is removed from said closing member portion.

16. A cartridge according to claim 15, wherein said grip portion projects from said closing member portion in a direction opposite a recessing direction of said recess.

17. A cartridge according to claim 16, where said grip portion is projected by a protrusion provided on said frame portion.

18. A cartridge according to claim 14, wherein said frame portion is provided with a flat flange around said recess, and said connecting portion connects said closing member portion and said flat flange.

19. A cartridge according to claim 14, wherein said separating portion is provided between said recess and said connecting portion in a direction perpendicular to a longitudinal direction of said hinge portion.

20. A cartridge according to claim 14, wherein said separating portion is provided between said recess and said hinge portion in a direction perpendicular to a longitudinal direction of said hinge portion.

21. A cartridge according to claim 14, wherein said cartridge includes a grip portion that is exposed by opening said closing member portion.

22. A cartridge according to claim 14, wherein said separating portion is between two cut away portions provided in said closing member portion to facilitate the removal of said closing member portion.

23. A cartridge according to claim 14, wherein said recess is a first recess, and said closing member portion is provided with a second recess for cooperating with said first recess to provide a space for accommodating said cartridge.

24. A cartridge according to claim 14, wherein said cartridge includes a photosensitive member and process means actable on said photosensitive member.

25. A cartridge according to claim 14, wherein said cartridge includes a developing device for developing an electrostatic latent image on a photosensitive member.

26. A cartridge according to claim 14, wherein said packing member is provided by vacuum pressure molding of thin recording material.

27. A packing member according to claim 1, wherein said closing member portion is provided so as to be openable by removing said separating portion from said closing member portion.

28. A packing member according to claim 1, wherein said frame portion, said closing member portion, and said hinge portion are integrally molded from a sheet of resin.

29. A cartridge according to claim 14, wherein said closing member portion is provided so as to be openable by removing said separating portion from said closing member portion.

30. A cartridge according to claim 14, wherein said frame portion, said closing member portion, and said hinge portion are integrally molded from a sheet of resin.

* * * * *